US009622625B2

(12) United States Patent
Maladen et al.

(10) Patent No.: US 9,622,625 B2
(45) Date of Patent: Apr. 18, 2017

(54) SANITARY TISSUE PRODUCTS WITH FREE FIBERS AND METHODS FOR MAKING SAME

(71) Applicant: The Procter & Gamble Company, Cincinnati, OH (US)

(72) Inventors: Ryan Dominic Maladen, Anderson Township, OH (US); John Allen Manifold, Sunman, IN (US); Ward William Ostendorf, West Chester, OH (US); Jeffrey Glen Sheehan, Symmes Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/574,422

(22) Filed: Dec. 18, 2014

(65) Prior Publication Data

US 2015/0173571 A1 Jun. 25, 2015

Related U.S. Application Data

(60) Provisional application No. 61/951,828, filed on Mar. 12, 2014, provisional application No. 61/918,398, filed on Dec. 19, 2013, provisional application No. 61/918,404, filed on Dec. 19, 2013, provisional application No. 61/918,409, filed on Dec. 19, 2013.

(51) Int. Cl.

| | |
|---|---|
| ***A47K 10/16*** | (2006.01) |
| ***D21H 27/00*** | (2006.01) |
| ***D21H 27/02*** | (2006.01) |
| ***D21H 27/40*** | (2006.01) |

(52) U.S. Cl.

CPC ..... *A47K 10/16* (2013.01); *D21H 27/002* (2013.01); *D21H 27/004* (2013.01); *D21H 27/005* (2013.01); *D21H 27/02* (2013.01); *D21H 27/40* (2013.01); *Y10T 428/24628* (2015.01); *Y10T 428/24802* (2015.01)

(58) Field of Classification Search

CPC ..... A47K 10/16; D21H 27/02; D21H 27/002; D21H 27/40; D21H 27/005; D21H 27/004; Y10T 428/24628; Y10T 428/24802

USPC ..... 428/156, 172, 174

See application file for complete search history.

(56) References Cited

U.S. PATENT DOCUMENTS

| | | | |
|---|---|---|---|
| 2010/0040825 | A1 | 2/2010 | Manifold et al. |
| 2013/0319625 | A1 | 12/2013 | Mohammadi et al. |

OTHER PUBLICATIONS

U.S. Appl. No. 14/574,415, filed Dec. 18, 2014, Ward William Ostendorf, et al.
U.S. Appl. No. 14/574,417, filed Dec. 18, 2014, Ward William Ostendorf, et al.
U.S. Appl. No. 14/574,418, filed Dec. 18, 2014, Ward William Ostendorf, et al.
U.S. Appl. No. 14/574,420, filed Dec. 18, 2014, Ryan Dominic Maladen, et al.
U.S. Appl. No. 14/574,421, filed Dec. 18, 2014, Ryan Dominic Maladen, et al.
All Office Action U.S. Appl. Nos. 14/574,415; 14/574,417; 14/574,418; 14/574,420; and 14/574,421.
PCT International Search Report dated Mar. 19, 2015—8 pages.

*Primary Examiner* — Catherine A Simone
(74) *Attorney, Agent, or Firm* — C. Brant Cook

(57) ABSTRACT

Sanitary tissue products that exhibit novel free fiber numbers compared to known sanitary tissue products as measured according to the Free Fiber Test Method described herein, and methods for making same, are provided.

19 Claims, 14 Drawing Sheets

SANITARY TISSUE PRODUCTS WITH FREE FIBERS AND METHODS FOR MAKING SAME

FIELD OF THE INVENTION

The present invention relates to sanitary tissue products that exhibit novel free fiber numbers compared to known sanitary tissue products as measured according to the Free Fiber Test Method described herein, and methods for making same.

BACKGROUND OF THE INVENTION

Market research has shown that "softness" is a property of paper-based consumer products, such as facial tissue, bath tissue, paper toweling, paper napkins, and the like, as well as other non-paper-based consumer products. It has been found that softness is important to consumers in selecting and determining the quality and desirability of such products. Therefore, it is advantageous to be able to demonstrate the softness of such a consumer product to the consumer, as a way of making the product more desirable.

One method for quantifying softness has been to determine metrics that describe fibers that emanate from the surface of a web substrate. While the configuration of fibers emanating from the surface of a web substrate may exist in many forms (e.g., fiber 'loops' where both ends of a fiber are attached to the surface and the middle of the fiber is not, 'free fibers' where one end of the fiber is attached to the surface and the distal end is not, or other configurations of 'free fibers' where the central portion of the fiber is attached to the surface and both ends are not attached, etc.) it can be advantageous to understand the metrics of the so-called 'free fibers.' This understanding of 'free fibers' is generally directed to those fibers attached to the underlying web substrate at one end while the distal end or part of the fiber is removed from the surface or fibers where a central portion of such fibers are attached to the surface and one or both ends are not. These metrics are sometimes known to those of skill in the art as the 'free fiber end' number or the 'fuzz-on-edge' value.

One method for determining the free fiber end number involves the manual (i.e., optical) counting of the number of free fibers whose one end is visible and unattached to a substrate surface. While this subjective method may be sufficient in certain circumstances, the overall free fiber end number can be affected by the person doing the counting (e.g., random error, fatigue, etc.) as well as the need for value judgments based upon what is believed to be contained within the image. Additionally, experience has shown that it can take between sixty and ninety minutes to perform a single analysis using this manual method. While the method itself may produce reasonable data, it can be difficult to perform adequate quality assurance to verify the data generated.

Another method used to quantify free fibers involves estimating the ratio between the length of the profile that outlines the free fibers and the width of the samples tested to provide an average fuzz-on-edge value or amount of free fibers. Such a method is described in U.S. Pat. No. 6,585,855 B2.

A significant draw-back of the above-mentioned analyses is that these processes can only provide one metric for the free fibers on a sample. These methods are difficult to adjust in order to provide other sample-related metrics. In other words, different tests have to be completed using different testing techniques and possibly apparatuses in order to provide a more complete picture of the metrics associated with a particular sample or product.

Additionally, having a more dynamic method of demonstrating the softness of a consumer product, using easily understood methods and familiar test materials, is clearly desirable. Compressibility and free fibers both contribute to product softness but are very different properties of the substrate. However a significant drawback of using the compressibility measure to express softness is that the results of scientific compressibility testing, while perhaps easily understood by one who is literate in the art of materials testing or in mathematics, may not be understood by the average consumer in relation to the subjective perception of softness. An ideal method for demonstrating softness would use the consumer product in a manner easily understood and related to by consumers. Such a method could be filmed or photographed and then used in advertisements, or it could be carried out in the direct presence of consumers, as a live demonstration in a store or other public location.

Accordingly, one problem faced by sanitary tissue product manufacturers is how to improve (i.e., increase) the "softness" properties of the sanitary tissue products based upon an increase in the number of free fibers as measured according to the Free Fiber Test Method described herein without significantly increasing the lint as measured according to the Lint Test Method described herein to better meet consumers' expectations for more clothlike, luxurious, and plush sanitary tissue products.

Accordingly, there exists a need for sanitary tissue products, for example bath tissue products, that exhibit improved "softness" properties based upon an increase in the number of free fibers as measured according to the Free Fiber Test Method described herein to provide consumers with sanitary tissue products that fulfill their desires and expectations for more comfortable and/or luxurious sanitary tissue products, and methods for making such sanitary tissue products.

SUMMARY OF THE INVENTION

The present invention fulfills the need described above by providing sanitary tissue products, for example bath tissue products, that exhibit a greater free fiber number (all references to free fiber number mean free fiber number/cm) than known sanitary tissue products as measured according to the Free Fiber Test Method described herein and methods for making such sanitary tissue products. One solution to the problem set forth above is achieved by making the sanitary tissue products or at least one fibrous structure ply employed in the sanitary tissue products on patterned molding members that impart three-dimensional (3D) patterns to the sanitary tissue products and/or fibrous structure plies made thereon, wherein the patterned molding members are designed such that the resulting sanitary tissue products, for example bath tissue products, made using the patterned molding members exhibit a greater free fiber number (for example greater than 26 and/or 27 or greater and/or 29 or greater and/or 30 or greater and/or 35 or greater) than known sanitary tissue products as measured according to the Free Fiber Test Method described herein. In example, this increase in free fiber number is accomplished without significantly increasing the lint (for example maintaining lint less than 15 and/or less than 12 and/or less than 10 and/or less than 9 and/or less than 8) of the sanitary tissue product and/or fibrous structure ply as measured according to the Lint Test Method described herein. Non-limiting examples of such patterned molding members include patterned felts, patterned forming wires, patterned rolls, patterned fabrics, and patterned belts utilized in conventional wet-pressed papermaking processes, air-laid papermaking processes, and/or wet-laid papermaking processes that produce 3D patterned sanitary tissue products and/or 3D patterned fibrous structure plies employed in sanitary tissue products. Other non-limiting examples of such patterned molding members include through-air-drying fabrics and through-air-drying belts utilized in through-air-drying papermaking processes that produce through-air-dried sanitary tissue products, for example 3D patterned through-air dried sanitary tissue products, and/or through-air-dried fibrous structure plies, for example 3D patterned through-air-dried fibrous structure plies, employed in sanitary tissue products.

In one example of the present invention, a sanitary tissue product comprising a plurality of pulp fibers, wherein the sanitary tissue product exhibits a Free Fiber number of greater than 26 as measured according to the Free Fiber Test Method described herein, is provided.

In another example of the present invention, a sanitary tissue product comprising at least one 3D patterned fibrous structure ply comprising a plurality of pulp fibers, wherein the sanitary tissue product exhibits a Free Fiber number of greater than 26 as measured according to the Free Fiber Test Method described herein, is provided.

In yet another example of the present invention, a sanitary tissue product, for example bath tissue product, comprising at least one creped through-air-dried fibrous structure ply comprising a plurality of pulp fibers, wherein the sanitary tissue product exhibits a Free Fiber number of greater than 26 as measured according to the Free Fiber Test Method described herein, is provided.

In even another example of the present invention, a multi-ply, for example two-ply, sanitary tissue product, for example bath tissue product, comprising a plurality of pulp fibers, wherein the multi-ply sanitary tissue product exhibits a Free Fiber number of greater than 26 as measured according to the Free Fiber Test Method described herein, is provided.

In even yet another example of the present invention, a multi-ply, for example two-ply, sanitary tissue product, for example bath tissue product, comprising at least one 3D patterned fibrous structure ply, for example a 3D patterned through-air-dried fibrous structure ply, comprising a plurality of pulp fibers, wherein the multi-ply sanitary tissue product exhibits a Free Fiber number of greater than 26 as measured according to the Free Fiber Test Method described herein, is provided.

In even yet another example of the present invention, a multi-ply sanitary tissue product comprising at least one creped through-air-dried fibrous structure ply comprising a plurality of pulp fibers, wherein the sanitary tissue product exhibits a Free Fiber number of greater than 26 as measured according to the Free Fiber Test Method described herein, is provided.

In still yet another example of the present invention, a method for making a single- or multi-ply sanitary tissue product according to the present invention, wherein the method comprises the steps of:

a. contacting a patterned molding member with a fibrous structure comprising a plurality of pulp fibers such that a 3D patterned fibrous structure ply that exhibits a Free Fiber number of greater than 26 is formed; and
b. making a single- or multi-ply sanitary tissue product according to the present invention comprising the 3D patterned fibrous structure ply, is provided.

Accordingly, the present invention provides sanitary tissue products, for example bath tissue products, that exhibit greater Free Fiber numbers than known sanitary tissue products, for example bath tissue products, as measured according to the Free Fiber Test Method described herein and methods for making same.

DETAILED DESCRIPTION OF THE INVENTION

Definitions

Figure 1A:
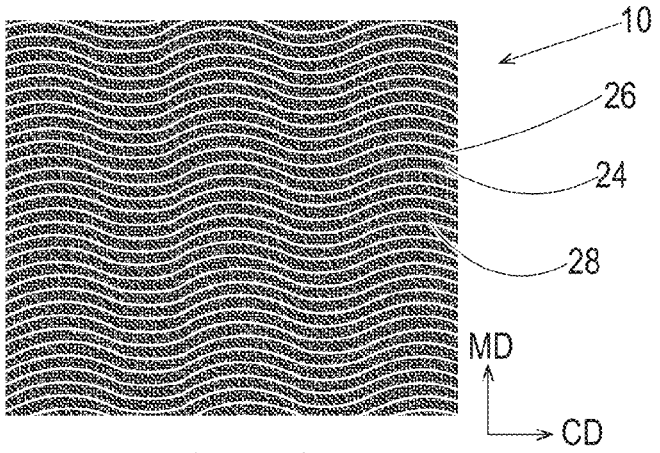
FIG. 1A is a schematic representation of an example of a molding member according to the present invention.

"Sanitary tissue product" as used herein means a soft, low density (i.e. <about 0.15 g/cm$^3$) article comprising one or more fibrous structure plies according to the present invention, wherein the sanitary tissue product is useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

The sanitary tissue products and/or fibrous structures of the present invention may exhibit a basis weight of greater than 15 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue products and/or fibrous structures of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may exhibit a sum of MD and CD dry tensile strength of greater than about 59 g/cm (150 yin) and/or from about 78 g/cm to about 394 g/cm and/or from about 98 g/cm to about 335 g/cm. In addition, the sanitary tissue product of the present invention may exhibit a sum of MD and CD dry tensile strength of greater than about 196 g/cm and/or from about 196 g/cm to about 394 g/cm and/or from about 216 g/cm to about 335 g/cm and/or from about 236 g/cm to about 315 g/cm. In one example, the sanitary tissue product exhibits a sum of MD and CD dry tensile strength of less than about 394 g/cm and/or less than about 335 g/cm.

In another example, the sanitary tissue products of the present invention may exhibit a sum of MD and CD dry tensile strength of greater than about 196 g/cm and/or greater than about 236 g/cm and/or greater than about 276 g/cm and/or greater than about 315 g/cm and/or greater than about 354 g/cm and/or greater than about 394 g/cm and/or from about 315 g/cm to about 1968 g/cm and/or from about 354 g/cm to about 1181 g/cm and/or from about 354 g/cm to about 984 g/cm and/or from about 394 g/cm to about 787 g/cm.

The sanitary tissue products of the present invention may exhibit an initial sum of MD and CD wet tensile strength of less than about 78 g/cm and/or less than about 59 g/cm and/or less than about 39 g/cm and/or less than about 29 g/cm.

The sanitary tissue products of the present invention may exhibit an initial sum of MD and CD wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm.

The sanitary tissue products of the present invention may exhibit a density (based on measuring caliper at 95 g/in$^2$) of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

In another example, the sanitary tissue products may be in the form of discrete sheets that are stacked within and dispensed from a container, such as a box.

The fibrous structures and/or sanitary tissue products of the present invention may comprise additives such as surface softening agents, for example silicones, quaternary ammonium compounds, aminosilicones, lotions, and mixtures thereof, temporary wet strength agents, permanent wet strength agents, bulk softening agents, wetting agents, latexes, especially surface-pattern-applied latexes, dry strength agents such as carboxymethylcellulose and starch, and other types of additives suitable for inclusion in and/or on sanitary tissue products.

"Fibrous structure" as used herein means a structure that comprises a plurality of pulp fibers. In one example, the fibrous structure may comprise a plurality of wood pulp fibers. In another example, the fibrous structure may comprise a plurality of non-wood pulp fibers, for example plant fibers, synthetic staple fibers, and mixtures thereof. In still another example, in addition to pulp fibers, the fibrous structure may comprise a plurality of filaments, such as polymeric filaments, for example thermoplastic filaments such as polyolefin filaments (i.e., polypropylene filaments) and/or hydroxyl polymer filaments, for example polyvinyl alcohol filaments and/or polysaccharide filaments such as starch filaments. In one example, a fibrous structure according to the present invention means an orderly arrangement of fibers alone and with filaments within a structure in order to perform a function. Non-limiting examples of fibrous structures of the present invention include paper.

Non-limiting examples of processes for making fibrous structures include known wet-laid papermaking processes, for example conventional wet-pressed papermaking processes, through-air-dried papermaking processes, fabric creped papermaking processes, belt creped papermaking processes, and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire, fabric, or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, often referred to as a parent roll, and may subsequently be converted into a finished product, e.g. a single- or multi-ply sanitary tissue product.

The fibrous structures of the present invention may be homogeneous or may be layered. If layered, the fibrous structures may comprise at least two and/or at least three and/or at least four and/or at least five layers of fiber and/or filament compositions.

In one example, the fibrous structure of the present invention consists essentially of fibers, for example pulp fibers, such as cellulosic pulp fibers and more particularly wood pulp fibers.

In another example, the fibrous structure of the present invention comprises fibers and is void of filaments.

In still another example, the fibrous structures of the present invention comprises filaments and fibers, such as a co-formed fibrous structure.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include pulp fibers, such as wood pulp fibers, and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified fibrous structure. U.S. Pat. Nos. 4,300,981 and 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Differential density", as used herein, means a fibrous structure and/or sanitary tissue product that comprises one or more regions of relatively low fiber density, which are referred to as pillow regions, and one or more regions of relatively high fiber density, which are referred to as knuckle regions.

"Densified", as used herein means a portion of a fibrous structure and/or sanitary tissue product that is characterized by regions of relatively high fiber density (knuckle regions).

"Non-densified", as used herein, means a portion of a fibrous structure and/or sanitary tissue product that exhibits a lesser density (one or more regions of relatively lower fiber density) (pillow regions) than another portion (for example a knuckle region) of the fibrous structure and/or sanitary tissue product.

"3D pattern" with respect to a fibrous structure and/or sanitary tissue product's surface in accordance with the present invention means herein a pattern that is present on at least one surface of the fibrous structure and/or sanitary tissue product. The 3D pattern texturizes the surface of the fibrous structure and/or sanitary tissue product, for example by providing the surface with protrusions and/or depressions. The 3D pattern on the surface of the fibrous structure and/or sanitary tissue product is made by making the sanitary tissue product or at least one fibrous structure ply employed in the sanitary tissue product on a patterned molding member that imparts the 3D pattern to the sanitary tissue products and/or fibrous structure plies made thereon. For example, the 3D pattern may comprise a series of line elements, such as a series of line elements that are substantially oriented in the cross-machine direction of the fibrous structure and/or sanitary tissue product.

"Line element" as used herein means a portion of a fibrous structure's surface being in the shape of a line, which may be continuous, discrete, interrupted, and/or partial line with respect to a fibrous structure on which it is present. The line element may be of any suitable shape such as straight, bent, kinked, curled, curvilinear, serpentine, sinusoidal and mixtures thereof, that may form regular or irregular periodic or non-periodic lattice work of structures wherein the line element exhibits a length along its path of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm. In one example, the line element may comprise a plurality of discrete elements, such as dots and/or dashes for example, that are oriented together to form a line element of the present invention. In another example, the line element may comprise a combination of line segments and discrete elements, such as dots and/or dashes for example, that are oriented together to form a line element of the present invention. In another example, the line element may be formed by a plurality of discrete shapes that together form a line element. In one example, the line element may comprise discrete shapes selected from the group consisting of: dots, dashes, triangles, squares, ellipses, and mixtures thereof.

The line element may exhibit an aspect ratio of greater than 1.5:1 and/or greater than 1.75:1 and/or greater than 2:1 and/or greater than 5:1 along the path of the line element. In one example, the line element exhibits a length along its path of at least 2 mm and/or at least 4 mm and/or at least 6 mm and/or at least 1 cm to about 30 cm and/or to about 27 cm and/or to about 20 cm and/or to about 15 cm and/or to about 10.16 cm and/or to about 8 cm and/or to about 6 cm and/or to about 4 cm.

Different line elements may exhibit different common intensive properties. For example, different line elements may exhibit different densities and/or basis weights. In one example, the common intensive property is selected from the group consisting of: density, basis weight, elevation, opacity, crepe frequency, and combinations thereof. In one example the common intensive property is density. In another example, the common intensive property is elevation. In one example, a fibrous structure of the present invention comprises a first series of line elements and a second series of line elements. For example, the line elements of the first series of line elements may exhibit the same densities, which are lower than the densities of the line elements of the second series of line elements. In another example, the line elements of the first series of line elements may exhibit the same elevations, which are higher than the elevations of the line elements of the second series of line elements. In another example, the line elements of the first series of line elements may exhibit the same basis weights, which are lower than the basis weights of the line elements of the second series of line elements.

In one example, the line element is a straight or substantially straight line element. In another example, the line element is a curvilinear line element, such as a sinusoidal line element. Unless otherwise stated, the line elements of the present invention are present on a surface of a fibrous structure In one example, the line element and/or line element forming component is continuous or substantially continuous within a fibrous structure, for example in one case one or more 11 cm×11 cm sheets of fibrous structure.

The line elements may exhibit different widths along their lengths of their paths, between two or more different line elements and/or the line elements may exhibit different lengths. Different line elements may exhibit different widths and/or lengths along their respective paths.

In one example, the surface pattern of the present invention comprises a plurality of parallel line elements. The plurality of parallel line elements may be a series of parallel line elements. In one example, the plurality of parallel line elements may comprise a plurality of parallel sinusoidal line elements.

"Embossed" as used herein with respect to a fibrous structure and/or sanitary tissue product means that a fibrous structure and/or sanitary tissue product has been subjected to a process which converts a smooth surfaced fibrous structure and/or sanitary tissue product to a decorative surface by replicating a design on one or more emboss rolls, which form a nip through which the fibrous structure and/or sanitary tissue product passes. Embossed does not include creping, microcreping, printing or other processes that may also impart a texture and/or decorative pattern to a fibrous structure and/or sanitary tissue product.

In one example, the line elements of the present invention may comprise wet texture, such as being formed by wet molding and/or through-air-drying via a fabric and/or an imprinted through-air-drying fabric. In one example, the wet texture line elements are water-resistant.

"Water-resistant" as it refers to a surface pattern or part thereof means that a line element and/or pattern comprising the line element retains its structure and/or integrity after being saturated by water and the line element and/or pattern is still visible to a consumer. In one example, the line elements and/or pattern may be water-resistant.

"Discrete" as it refers to a line element means that a line element has at least one immediate adjacent region of the fibrous structure that is different from the line element. In one example, a plurality of parallel line elements are discrete and/or separated from adjacent parallel line elements by a channel. The channel may exhibit a complementary shape to the parallel line elements. In other words, if the plurality of parallel line elements are straight lines, then the channels separating the parallel line elements would be straight. Likewise, if the plurality of parallel line elements are sinusoidal lines, then the channels separating the parallel line elements would be sinusoidal. The channels may exhibit the same widths and/or lengths as the line elements.

"Machine direction oriented" as it refers to a line element a line element means that the line element has a primary direction that is at an angle of less than 45° and/or less than 30° and/or less than 15° and/or less than 5° and/or to about 0° with respect to the machine direction of the 3D patterned fibrous structure ply and/or sanitary tissue product comprising the 3D patterned fibrous structure ply.

"Substantially cross machine direction oriented" as it refers to a line element and/or series of line elements means that the line element and/or series of line elements has a primary direction that is at an angle of less than 20° and/or less than 15° and/or less than 10° and/or less than 5° and/or to about 0° with respect to the cross-machine direction of the 3D patterned fibrous structure ply and/or sanitary tissue product comprising the 3D patterned fibrous structure ply. In one example, the line element and/or series of line elements has a primary direction that is an angle of from about 3° to about 0° with respect to the cross-machine direction of the 3D patterned fibrous structure ply and/or sanitary tissue product comprising the 3D patterned fibrous structure ply.

"Wet textured" as used herein means that a 3D patterned fibrous structure ply comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. For purposes of the present invention, the collection devices used for imparting wet texture to the fibrous structures would be patterned to result in the fibrous structures comprising a surface pattern comprising a plurality of parallel line elements wherein at least one, two, three, or more, for example all of the parallel line elements exhibit a non-constant width along the length of the parallel line elements. This is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure by embossing rolls during converting of the fibrous structure.

"Non-rolled" as used herein with respect to a fibrous structure and/or sanitary tissue product of the present invention means that the fibrous structure and/or sanitary tissue product is an individual sheet (for example not connected to adjacent sheets by perforation lines. However, two or more individual sheets may be interleaved with one another) that is not convolutedly wound about a core or itself. For example, a non-rolled product comprises a facial tissue.

"Stack Compressibility Test Method" as used herein means the Stack Compressibility Test Method described herein.

"Slip Stick Coefficient of Friction Test Method" as used herein means the Slip Stick Coefficient of Friction Test Method described herein.

"Plate Stiffness Test Method" as used herein means the Plate Stiffness Test Method described herein.

"Creped" as used herein means creped off of a Yankee dryer or other similar roll and/or fabric creped and/or belt creped. Rush transfer of a fibrous structure alone does not result in a "creped" fibrous structure or "creped" sanitary tissue product for purposes of the present invention.

As used herein, "image file formats" (or "image files") are standardized means of organizing and storing digital images. Image files are composed of either pixels, vector (geometric) data, or a combination of the two. Whatever the format, the files are rasterized to pixels when displayed on most graphic displays. The pixels that constitute an image are ordered as a grid (columns and rows); each pixel consists of numbers representing magnitudes of intensity and color.

Image file size—expressed as the number of bytes—increases with the number of pixels composing an image, and the color depth of the pixels. The greater the number of rows and columns, the greater the image resolution for a fixed field of view and the larger the image file. Image files can be provided as grey-scale image files, be oriented as may be required by the end user, and be readily converted to other file formats by processing.

High resolution cameras and scanners can produce large image files, ranging from hundreds of kilobytes to gigabytes, per the camera's resolution and the image-storage format capacity. For example, an image recorded by a 12 megapixel camera; since each pixel uses 3 bytes to record true color, the uncompressed image would occupy 36,000,000 bytes of memory—a great amount of digital storage for one image, given that cameras must record and store many images to be practical. Faced with large file sizes, both within the camera and a storage disc, image file formats were developed to store such large images. An overview of the major graphic file formats some of which use compression to reduce file size follows below.

Including proprietary types, there are hundreds of image file types. The PNG, JPEG, TIFF, and GIF formats are most often used to display images. These graphic formats can be separated into two main families of graphics: raster and vector.

In addition to straight image formats, metafile formats are portable intermediate formats which can include both raster and vector information. Examples are application-independent formats such as WMF and EMF. Several known applications open metafiles and then save them in their own native format. Another format, the page description language (PDL) describes the layout of a printed page containing text, objects and images in textual or binary data streams. Examples include PostScript, PDF and PCL.

As used herein, a "gray scale" or "grey scale" digital image is an image in which the value of each pixel is a single sample, that is, it carries only intensity information These images are composed exclusively of shades of gray, varying from black at the weakest intensity to white at the strongest. Gray scale images are distinct from one-bit bi-tonal black-and-white images, which in the context of computer imaging are images with only the two colors, black, and white (also called bi-level or binary images). Gray scale images are often the result of measuring the intensity of light at each pixel in a single band of the electromagnetic spectrum (e.g. infrared, visible light, ultraviolet, etc.), and in such cases they are monochromatic proper when only a given frequency is captured. But also they can be synthesized from a full color image; see the section about converting to gray scale.

For gray scale images the intensity of a pixel is expressed within a given range between a minimum and a maximum, inclusive. This range is represented in an abstract way as a range from 0 (total absence, black) and 1 (total presence, white), with any fractional values in between. This notation is used in academic papers, but it must be noted that this does not define what "black" or "white" is in terms of colorimetry. Another convention is to employ percentages, so the scale is then from 0% to 100%. This is used for a more intuitive approach, but if only integer values are used, the range encompasses a total of only 101 intensities, which are insufficient to represent a broad gradient of grays. In computing, although the gray scale can be computed through rational numbers, image pixels are stored in binary, quantized form. Some early gray scale monitors can only show up to sixteen (4-bit) different shades, but today gray scale images (as photographs) intended for visual display (both on screen and printed) are commonly stored with 8 bits per sampled pixel, which allows 256 different intensities (i.e., shades of gray) to be recorded, typically on a non-linear scale. The precision provided by this format is barely sufficient to avoid visible banding artifacts, but very convenient for programming due to the fact that a single pixel then occupies a single byte.

Technical uses (e.g. in medical imaging or remote sensing applications) often require more levels, to make full use of the sensor accuracy (typically 10 or 12 bits per sample) and to guard against round-off errors in computations. Sixteen bits per sample (65,536 levels) is a convenient choice for such uses, as computers manage 16-bit words efficiently. The TIFF and the PNG (among other) image file formats generally support 16-bit gray scale natively, although browsers and many imaging programs tend to ignore the low order 8 bits of each pixel. In any regard, no matter what pixel depth is used, the binary representations one of skill in the art will presume that 0 is black and the maximum value (255 at 8 bpp, 65,535 at 16 bpp, etc.) is white, if not otherwise noted.

Conversion of a color image to gray scale is not unique; different weighting of the color channels effectively represent the effect of shooting black-and-white film with different-colored photographic filters on the camera and/or scanner. A common strategy is to match the luminance of the gray scale image to the luminance of the color image.

To convert any color to a gray scale representation of its luminance, first one must obtain the values of its red, green, and blue (RGB) primaries in linear intensity encoding, by gamma expansion. Then, add together 30% of the red value, 59% of the green value, and 11% of the blue value (these weights depend on the exact choice of the RGB primaries, but are typical). Regardless of the scale employed (0.0 to 1.0, 0 to 255, 0% to 100%, etc.), the resultant number is the desired linear luminance value; it typically needs to be gamma compressed to get back to a conventional gray scale representation.

As used herein, a "binary image" is a digital image that has only two possible values for each pixel. Typically the two colors used for a binary image are black and white though any two colors can be used. The color used for the object(s) in the image is the foreground color while the rest of the image is the background color. In the document scanning industry this is often referred to as bi-tonal.

Binary images are also called bi-level or two-level. This means that each pixel is stored as a single bit (0 or 1). The names black-and-white, B&W, monochrome or monochromatic are often used for this concept, but may also designate any images that have only one sample per pixel, such as gray scale images. In Photoshop parlance, a binary image is the same as an image in "Bitmap" mode.

Binary images often arise in digital image processing as masks or as the result of certain operations such as segmentation, thresholding, and dithering. A binary image is usually stored in memory as a bitmap, a packed array of bits. A 640×480 image can require 37.5 KB of storage. Because of the small size of the image files, fax machines and document management solutions usually use this format.

Sanitary Tissue Product

The sanitary tissue products of the present invention may be single-ply or multi-ply sanitary tissue products. In other words, the sanitary tissue products of the present invention may comprise one or more fibrous structures. In one example, the fibrous structures and/or sanitary tissue products of the present invention are made from a plurality of pulp fibers, for example wood pulp fibers and/or other cellulosic pulp fibers, for example trichomes. In addition to the pulp fibers, the fibrous structures and/or sanitary tissue products of the present invention may comprise synthetic fibers and/or filaments.

In one example of the present invention, a sanitary tissue product comprising a plurality of pulp fibers, wherein the sanitary tissue product exhibits a Free Fiber number of greater than 26 and/or 27 or greater and/or 29 or greater and/or 30 or greater and/or 35 or greater as measured according to the Free Fiber Test Method described herein.

In another example of the present invention, a sanitary tissue product comprising at least one 3D patterned fibrous structure ply comprising a plurality of pulp fibers, wherein the sanitary tissue product exhibits a Free Fiber number of greater than 26 and/or 27 or greater and/or 29 or greater and/or 30 or greater and/or 35 or greater as measured according to the Free Fiber Test Method described herein.

In yet another example of the present invention, a sanitary tissue product, for example bath tissue product, comprising at least one creped through-air-dried fibrous structure ply comprising a plurality of pulp fibers, wherein the sanitary tissue product exhibits a Free Fiber number of greater than 26 and/or 27 or greater and/or 29 or greater and/or 30 or greater and/or 35 or greater as measured according to the Free Fiber Test Method described herein.

In even another example of the present invention, a multi-ply, for example two-ply, sanitary tissue product, for example bath tissue product, comprising a plurality of pulp fibers, wherein the multi-ply sanitary tissue product exhibits a Free Fiber number of greater than 26 and/or 27 or greater and/or 29 or greater and/or 30 or greater and/or 35 or greater as measured according to the Free Fiber Test Method described herein.

In even yet another example of the present invention, a multi-ply, for example two-ply, sanitary tissue product, for example bath tissue product, comprising at least one 3D patterned fibrous structure ply, for example a 3D patterned through-air-dried fibrous structure ply, comprising a plurality of pulp fibers, wherein the multi-ply sanitary tissue product exhibits a Free Fiber number of greater than 26 and/or 27 or greater and/or 29 or greater and/or 30 or greater and/or 35 or greater as measured according to the Free Fiber Test Method described herein.

In even yet another example of the present invention, a multi-ply sanitary tissue product comprising at least one creped through-air-dried fibrous structure ply comprising a plurality of pulp fibers, wherein the sanitary tissue product exhibits a Free Fiber number of greater than 26 and/or 27 or greater and/or 29 or greater and/or 30 or greater and/or 35 or greater as measured according to the Free Fiber Test Method described herein.

In one example, the fibrous structure and/or sanitary tissue product of the present invention exhibits a Free Fiber number of the present invention on both sides of the fibrous structure and/or sanitary tissue product. In another example, the fibrous structure and/or sanitary tissue product of the present invention exhibits a Free Fiber number of the present invention on the fabric side (side that contacts the molding member (through-air-drying fabric and/or belt)). In still another example, the fibrous structure and/or sanitary tissue product of the present invention exhibits a Free Fiber number of the present invention on the wire side (side that does not contact the molding member (through-air-drying fabric and/or belt)). In even yet another example, the fibrous structure and/or sanitary tissue product of the present invention exhibits a Free Fiber number of the present invention on the a consumer user side (side that contacts a consumer's skin during use.

Table 1 below shows the Free Fiber numbers (FF/cm) for inventive samples inventive samples and for commercially available and/or known samples of sanitary tissue products, for example bath tissue products.

TABLE 1

| Product | 3D Patterned? | FF/cm | Lint |
|---|---|---|---|
| Invention | Yes | 37.5 | 7.1 |
| Invention | Yes | 27 | 8.5 |
| Invention | Yes | 32 | 7.2 |
| Charmin ® Ultra Soft | Yes | 12.15 | 8 |
| Charmin ® Super Premium | Yes | 18 | 7.4 |
| Charmin ® Ultra Strong | Yes | 10.3 | 4.3 |
| Charmin ® Ultra Strong | Yes | 11 | 4 |
| Charmin ® Sensitive | Yes | 25.44 | 4 |
| Charmin ® Trichome-containing | Yes | 19.46 | 9.5 |
| Charmin ® Ultra Soft | Yes | 16 | 8 |
| Charmin ® Basic | Yes | 8 | 4 |
| Scott ® Extra Soft | Yes | 10.56 | 2.92 |
| Cottonelle ® Ultra | Yes | 18.19 | 3.64 |
| Cottonelle ® | Yes | 13 | 6.3 |
| Scott ® 1000 | No | 0.44 | 1.3 |
| Quilted Northern ® Ultra Soft & Strong | No | 18 | 4.7 |
| Quilted Northern ® Ultra Plush - 3P A | No | 26.5 | 5.3 |
| Quilted Northern ® Ultra Plush - 3P B | No | 13.2 | 6 |
| Kirkland ® Signature | No | 6.94 | 4.1 |

The fibrous structures and/or sanitary tissue products of the present invention may be creped or uncreped.

The fibrous structures and/or sanitary tissue products of the present invention may be wet-laid or air-laid.

The fibrous structures and/or sanitary tissue products of the present invention may be embossed.

The fibrous structures and/or sanitary tissue products of the present invention may comprise a surface softening agent or be void of a surface softening agent. In one example, the sanitary tissue product is a non-lotioned sanitary tissue product.

The fibrous structures and/or sanitary tissue products of the present invention may comprise trichome fibers and/or may be void of trichome fibers.

The fibrous structures and/or sanitary tissue products of the present invention may exhibit the compressibility values alone or in combination with the plate stiffness values with or without the aid of surface softening agents. In other words, the sanitary tissue products of the present invention may exhibit the compressibility values described above alone or in combination with the plate stiffness values when surface softening agents are not present on and/or in the sanitary tissue products, in other words the sanitary tissue product is void of surface softening agents. This does not mean that the sanitary tissue products themselves cannot include surface softening agents. It simply means that when the sanitary tissue product is made without adding the surface softening agents, the sanitary tissue product exhibits the compressibility and plate stiffness values of the present invention. Addition of a surface softening agent to such a sanitary tissue product within the scope of the present invention (without the need of a surface softening agent or other chemistry) may enhance the sanitary tissue product's compressibility and/or plate stiffness to an extent. However, sanitary tissue products that need the inclusion of surface softening agents on and/or in them to be within the scope of the present invention, in other words to achieve the compressibility and plate stiffness values of the present invention, are outside the scope of the present invention.

Patterned Molding Members

The sanitary tissue products of the present invention and/or 3D patterned fibrous structure plies employed in the sanitary tissue products of the present invention are formed on patterned molding members that result in the sanitary tissue products of the present invention. In one example, the pattern molding member comprises a non-random repeating pattern. In another example, the pattern molding member comprises a resinous pattern.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

Figure 1B:
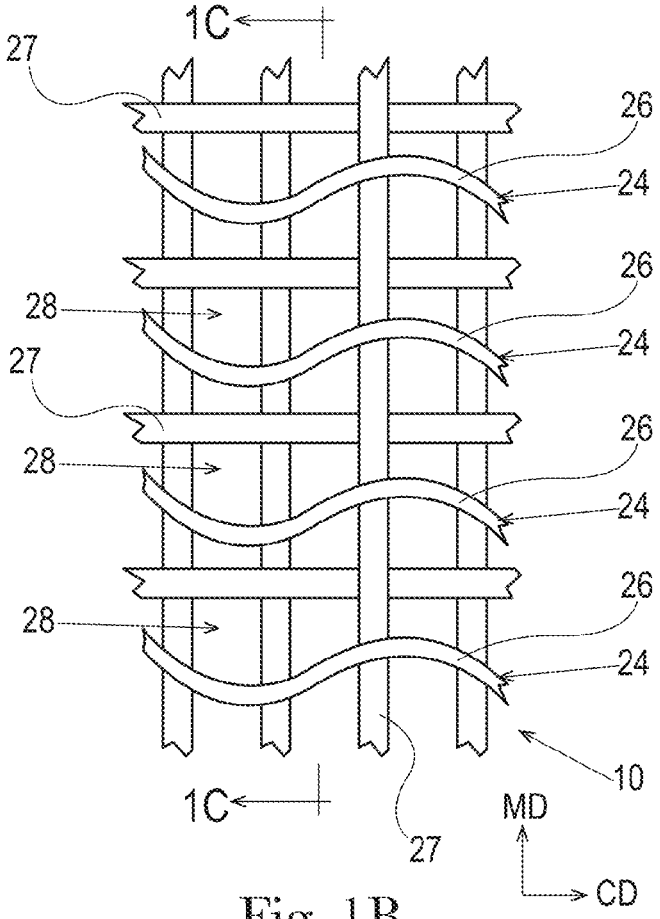
FIG. 1B is a further schematic representation of a portion of the molding member of FIG. 1A.
Figure 2A:
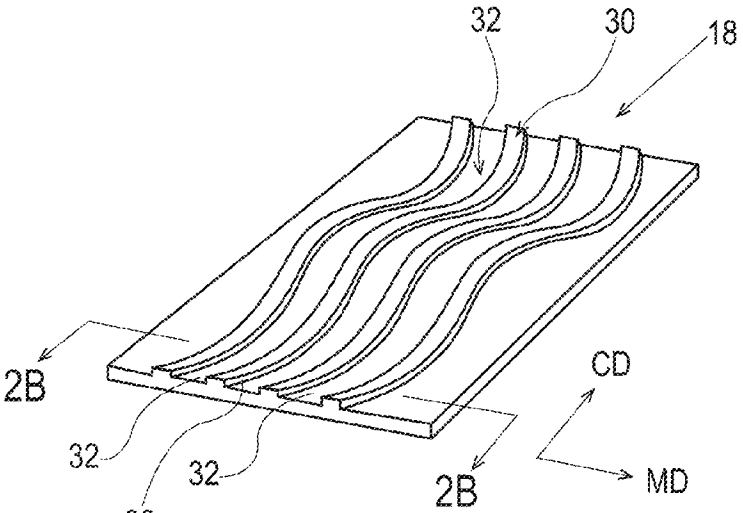
FIG. 2A is a schematic representation of a sanitary tissue product made using the molding member of FIG. 1A.
Figure 2B:
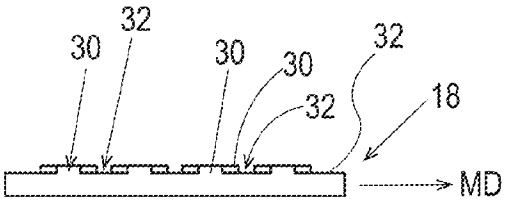
FIG. 2B is a cross-sectional view of FIG. 2A taken along line 2B-2B.
Figure 1C:
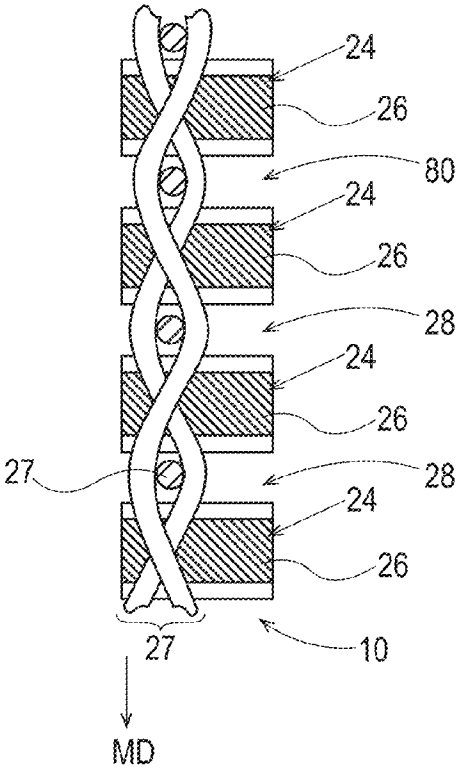
FIG. 1C is a cross-sectional view of FIG. 1B taken along line 1C-1C.
Figure 2C:
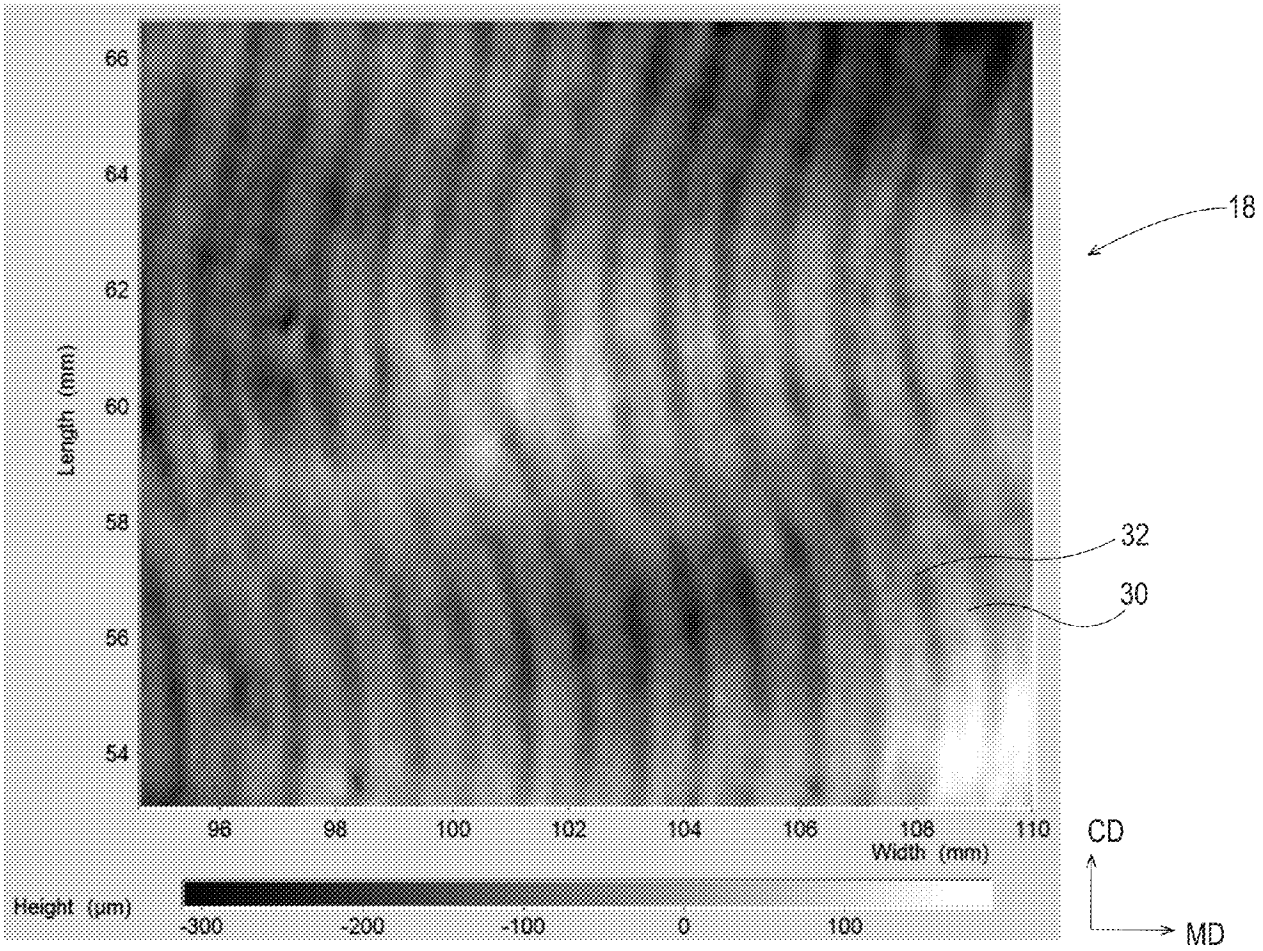
FIG. 2C is a MikroCAD image of a sanitary tissue product made using the molding member of FIG. 1A.
Figure 2D:
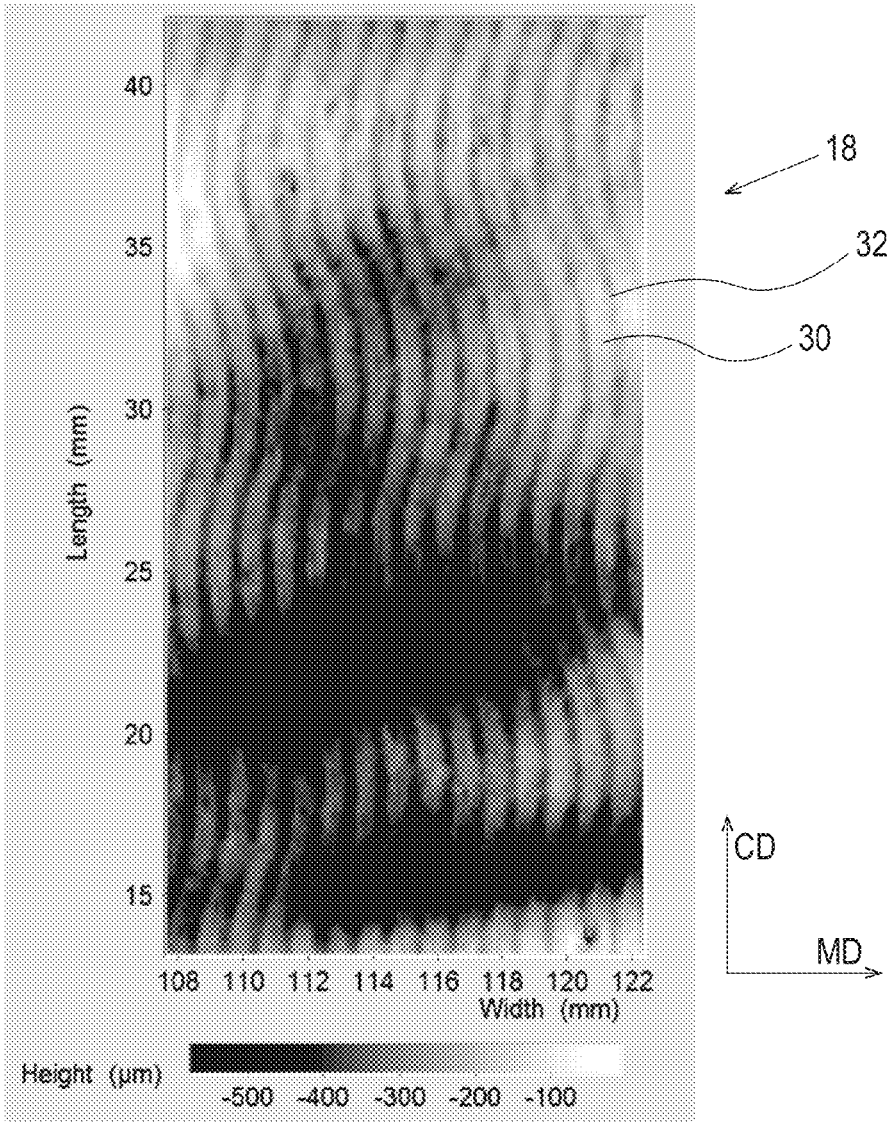
FIG. 2D is a magnified portion of the MikroCAD image of FIG. 2C.

As shown in FIGS. 1A-1C, a non-limiting example of a patterned molding member suitable for use in the present invention comprises a through-air-drying belt 10. The through-air-drying belt 10 comprises a plurality of semi-continuous knuckles 24 formed by semi-continuous line segments of resin 26 arranged in a non-random, repeating pattern, for example a substantially cross-machine direction repeating pattern of semi-continuous lines supported on a support fabric comprising filaments 27. In this case, the semi-continuous lines are curvilinear, for example sinusoidal. The semi-continuous knuckles 24 are spaced from adjacent semi-continuous knuckles 24 by semi-continuous pillows 28, which constitute deflection conduits into which portions of a fibrous structure ply being made on the through-air-drying belt 10 of FIGS. 1A-1C deflect. As shown in FIGS. 2A and 2B, a resulting sanitary tissue product 18 being made on the through-air-drying belt 10 of FIGS. 1A-1C comprises semi-continuous pillow regions 30 imparted by the semi-continuous pillows 28 of the through-air-drying belt 10 of FIGS. 1A-1C. The sanitary tissue product 18 further comprises semi-continuous knuckle regions 32 imparted by the semi-continuous knuckles 24 of the through-air-drying belt 10 of FIGS. 1A-1C. The semi-continuous pillow regions 30 and semi-continuous knuckle regions 32 may exhibit different densities, for example, one or more of the semi-continuous knuckle regions 32 may exhibit a density that is greater than the density of one or more of the semi-continuous pillow regions 30.

Without wishing to be bound by theory, foreshortening (dry & wet crepe, fabric crepe, rush transfer, etc) is an integral part of fibrous structure and/or sanitary tissue paper making, helping to produce the desired balance of strength, stretch, softness, absorbency, etc. Fibrous structure support, transport and molding members used in the papermaking process, such as rolls, wires, felts, fabrics, belts, etc. have been variously engineered to interact with foreshortening to further control the fibrous structure and/or sanitary tissue product properties. In the past, it has been thought that it is advantageous to avoid highly CD dominant knuckle designs that result in MD oscillations of foreshortening forces. However, it has unexpectedly been found that the molding member of FIGS. 1A-1C provides patterned molding member having CD dominant semi-continuous knuckles that to enable better control of the fibrous structure's molding and stretch while overcoming the negatives of the past.

Non-limiting Examples of Making Sanitary Tissue Products

The sanitary tissue products of the present invention may be made by any suitable papermaking process so long as a molding member of the present invention is used to making the sanitary tissue product or at least one fibrous structure ply of the sanitary tissue product and that the sanitary tissue product exhibits a compressibility and plate stiffness values of the present invention. The method may be a sanitary tissue product making process that uses a cylindrical dryer such as a Yankee (a Yankee-process) or it may be a Yankeeless process as is used to make substantially uniform density and/or uncreped fibrous structures and/or sanitary tissue products. Alternatively, the fibrous structures and/or sanitary tissue products may be made by an air-laid process and/or meltblown and/or spunbond processes and any combinations thereof so long as the fibrous structures and/or sanitary tissue products of the present invention are made thereby.

Figure 3:
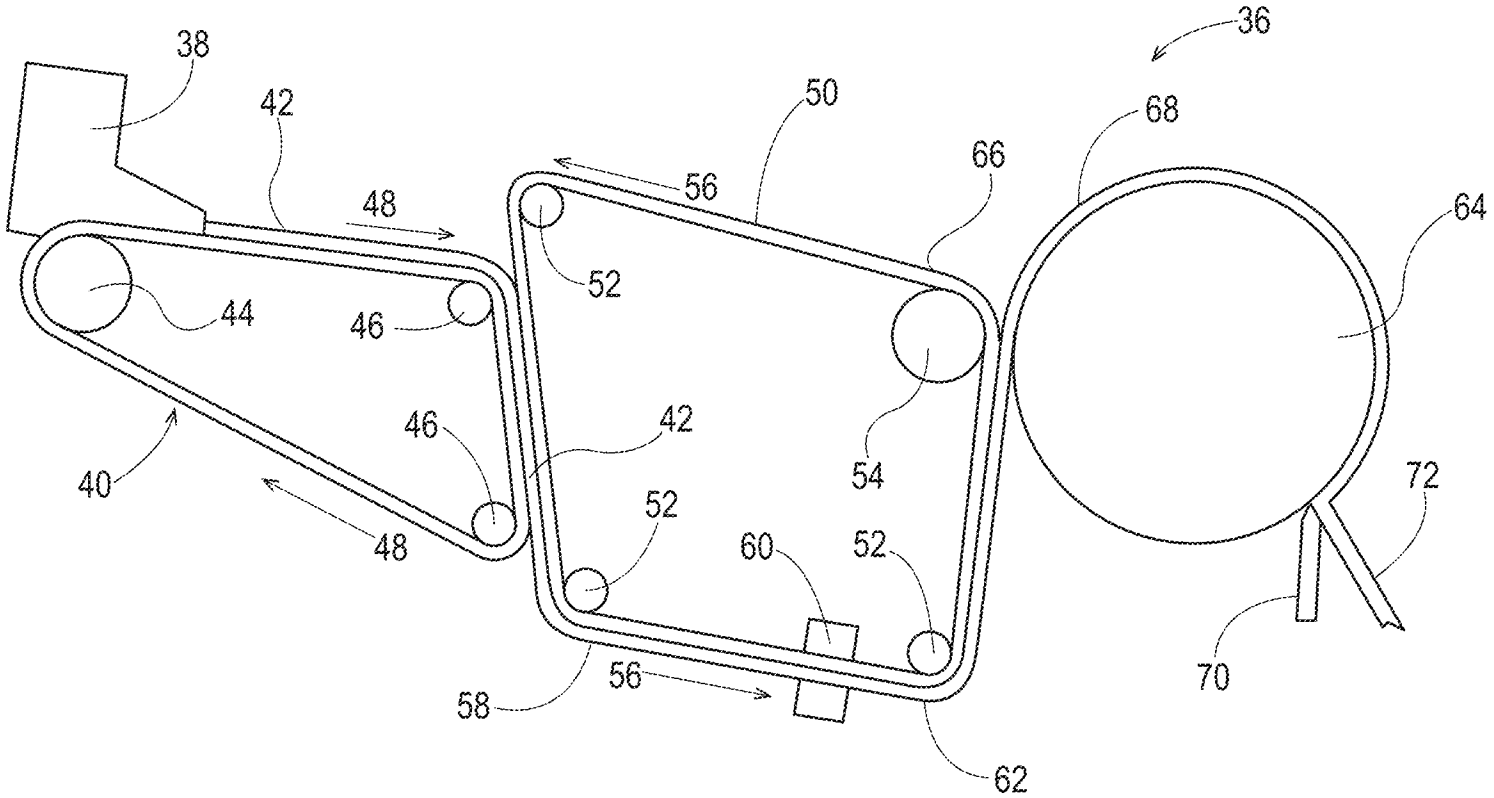
FIG. 3 is a schematic representation of an example of a through-air-drying papermaking process for making a sanitary tissue product according to the present invention.

As shown in FIG. 3, one example of a process and equipment, represented as 36 for making a sanitary tissue product according to the present invention comprises supplying an aqueous dispersion of fibers (a fibrous furnish or fiber slurry) to a headbox 38 which can be of any convenient design. From headbox 38 the aqueous dispersion of fibers is delivered to a first foraminous member 40 which is typically a Fourdrinier wire, to produce an embryonic fibrous structure 42.

The first foraminous member 40 may be supported by a breast roll 44 and a plurality of return rolls 46 of which only two are shown. The first foraminous member 40 can be propelled in the direction indicated by directional arrow 48 by a drive means, not shown. Optional auxiliary units and/or devices commonly associated fibrous structure making machines and with the first foraminous member 40, but not shown, include forming boards, hydrofoils, vacuum boxes, tension rolls, support rolls, wire cleaning showers, and the like.

After the aqueous dispersion of fibers is deposited onto the first foraminous member 40, embryonic fibrous structure 42 is formed, typically by the removal of a portion of the aqueous dispersing medium by techniques well known to those skilled in the art. Vacuum boxes, forming boards, hydrofoils, and the like are useful in effecting water removal. The embryonic fibrous structure 42 may travel with the first foraminous member 40 about return roll 46 and is brought into contact with a patterned molding member 50, such as a 3D patterned through-air-drying belt. While in contact with the patterned molding member 50, the embryonic fibrous structure 42 will be deflected, rearranged, and/or further dewatered. This can be accomplished by applying differential speeds and/or pressures.

The patterned molding member 50 may be in the form of an endless belt. In this simplified representation, the patterned molding member 50 passes around and about patterned molding member return rolls 52 and impression nip roll 54 and may travel in the direction indicated by directional arrow 56. Associated with patterned molding member 50, but not shown, may be various support rolls, other return rolls, cleaning means, drive means, and the like well known to those skilled in the art that may be commonly used in fibrous structure making machines.

After the embryonic fibrous structure 42 has been associated with the patterned molding member 50, fibers within the embryonic fibrous structure 42 are deflected into pillows and/or pillow network ("deflection conduits") present in the patterned molding member 50. In one example of this process step, there is essentially no water removal from the embryonic fibrous structure 42 through the deflection conduits after the embryonic fibrous structure 42 has been associated with the patterned molding member 50 but prior to the deflecting of the fibers into the deflection conduits. Further water removal from the embryonic fibrous structure 42 can occur during and/or after the time the fibers are being deflected into the deflection conduits. Water removal from the embryonic fibrous structure 42 may continue until the consistency of the embryonic fibrous structure 42 associated with patterned molding member 50 is increased to from about 25% to about 35%. Once this consistency of the embryonic fibrous structure 42 is achieved, then the embryonic fibrous structure 42 can be referred to as an intermediate fibrous structure 58. During the process of forming the embryonic fibrous structure 42, sufficient water may be removed, such as by a noncompressive process, from the embryonic fibrous structure 42 before it becomes associated with the patterned molding member 50 so that the consistency of the embryonic fibrous structure 42 may be from about 10% to about 30%.

While applicants decline to be bound by any particular theory of operation, it appears that the deflection of the fibers in the embryonic fibrous structure and water removal from the embryonic fibrous structure begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous structure, may cause an apparent increase in surface area of the embryonic fibrous structure. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous structure. This decrease in fiber mobility may tend to fix and/or freeze the fibers in place after they have been deflected and rearranged. Of course, the drying of the fibrous structure in a later step in the process of this invention serves to more firmly fix and/or freeze the fibers in position.

Any convenient means conventionally known in the papermaking art can be used to dry the intermediate fibrous structure 58. Examples of such suitable drying process include subjecting the intermediate fibrous structure 58 to conventional and/or flow-through dryers and/or Yankee dryers.

In one example of a drying process, the intermediate fibrous structure 58 in association with the patterned molding member 50 passes around the patterned molding member return roll 52 and travels in the direction indicated by directional arrow 56. The intermediate fibrous structure 58 may first pass through an optional predryer 60. This predryer 60 can be a conventional flow-through dryer (hot air dryer) well known to those skilled in the art. Optionally, the predryer 60 can be a so-called capillary dewatering apparatus. In such an apparatus, the intermediate fibrous structure 58 passes over a sector of a cylinder having preferential-capillary-size pores through its cylindrical-shaped porous cover. Optionally, the predryer 60 can be a combination capillary dewatering apparatus and flow-through dryer. The quantity of water removed in the predryer 60 may be controlled so that a predried fibrous structure 62 exiting the predryer 60 has a consistency of from about 30% to about 98%. The predried fibrous structure 62, which may still be associated with patterned molding member 50, may pass around another patterned molding member return roll 52 and as it travels to an impression nip roll 54. As the predried fibrous structure 62 passes through the nip formed between impression nip roll 54 and a surface of a Yankee dryer 64, the pattern formed by the top surface 66 of patterned molding member 50 is impressed into the predried fibrous structure 62 to form a 3D patterned fibrous structure 68. The imprinted fibrous structure 68 can then be adhered to the surface of the Yankee dryer 64 where it can be dried to a consistency of at least about 95%.

The 3D patterned fibrous structure 68 can then be foreshortened by creping the 3D patterned fibrous structure 68 with a creping blade 70 to remove the 3D patterned fibrous structure 68 from the surface of the Yankee dryer 64 resulting in the production of a 3D patterned creped fibrous structure 72 in accordance with the present invention. As used herein, foreshortening refers to the reduction in length of a dry (having a consistency of at least about 90% and/or at least about 95%) fibrous structure which occurs when energy is applied to the dry fibrous structure in such a way that the length of the fibrous structure is reduced and the fibers in the fibrous structure are rearranged with an accompanying disruption of fiber-fiber bonds. Foreshortening can be accomplished in any of several well-known ways. One common method of foreshortening is creping. The 3D patterned creped fibrous structure 72 may be subjected to post processing steps such as calendaring, tuft generating operations, and/or embossing and/or converting.

Figure 4:
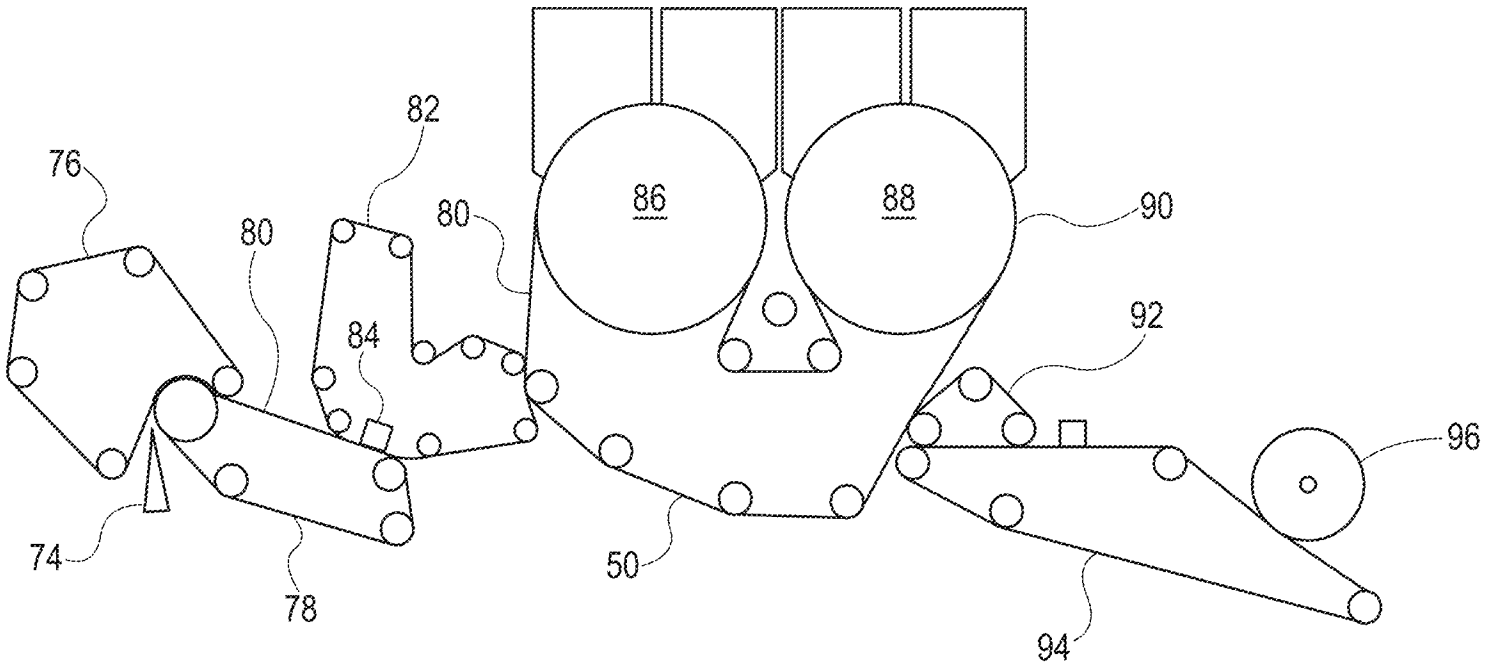
FIG. 4 is a schematic representation of an example of an uncreped through-air-drying papermaking process for making a sanitary tissue product according to the present invention.

Another example of a suitable papermaking process for making the sanitary tissue products of the present invention is illustrated in FIG. 4. FIG. 4 illustrates an uncreped through-air-drying process. In this example, a multi-layered headbox 74 deposits an aqueous suspension of papermaking fibers between forming wires 76 and 78 to form an embryonic fibrous structure 80. The embryonic fibrous structure 80 is transferred to a slower moving transfer fabric 82 with the aid of at least one vacuum box 84. The level of vacuum used for the fibrous structure transfers can be from about 3 to about 15 inches of mercury (76 to about 381 millimeters of mercury). The vacuum box 84 (negative pressure) can be supplemented or replaced by the use of positive pressure from the opposite side of the embryonic fibrous structure 80 to blow the embryonic fibrous structure 80 onto the next fabric in addition to or as a replacement for sucking it onto the next fabric with vacuum. Also, a vacuum roll or rolls can be used to replace the vacuum box(es) 84.

The embryonic fibrous structure 80 is then transferred to a molding member 50 of the present invention, such as a through-air-drying fabric, and passed over through-air-dryers 86 and 88 to dry the embryonic fibrous structure 80 to form a 3D patterned fibrous structure 90. While supported by the molding member 50, the 3D patterned fibrous structure 90 is finally dried to a consistency of about 94% percent or greater. After drying, the 3D patterned fibrous structure 90 is transferred from the molding member 50 to fabric 92 and thereafter briefly sandwiched between fabrics 92 and 94. The dried 3D patterned fibrous structure 90 remains with fabric 94 until it is wound up at the reel 96 ("parent roll") as a finished fibrous structure. Thereafter, the finished 3D patterned fibrous structure 90 can be unwound, calendered and converted into the sanitary tissue product of the present invention, such as a roll of bath tissue, in any suitable manner.

Figure 5:
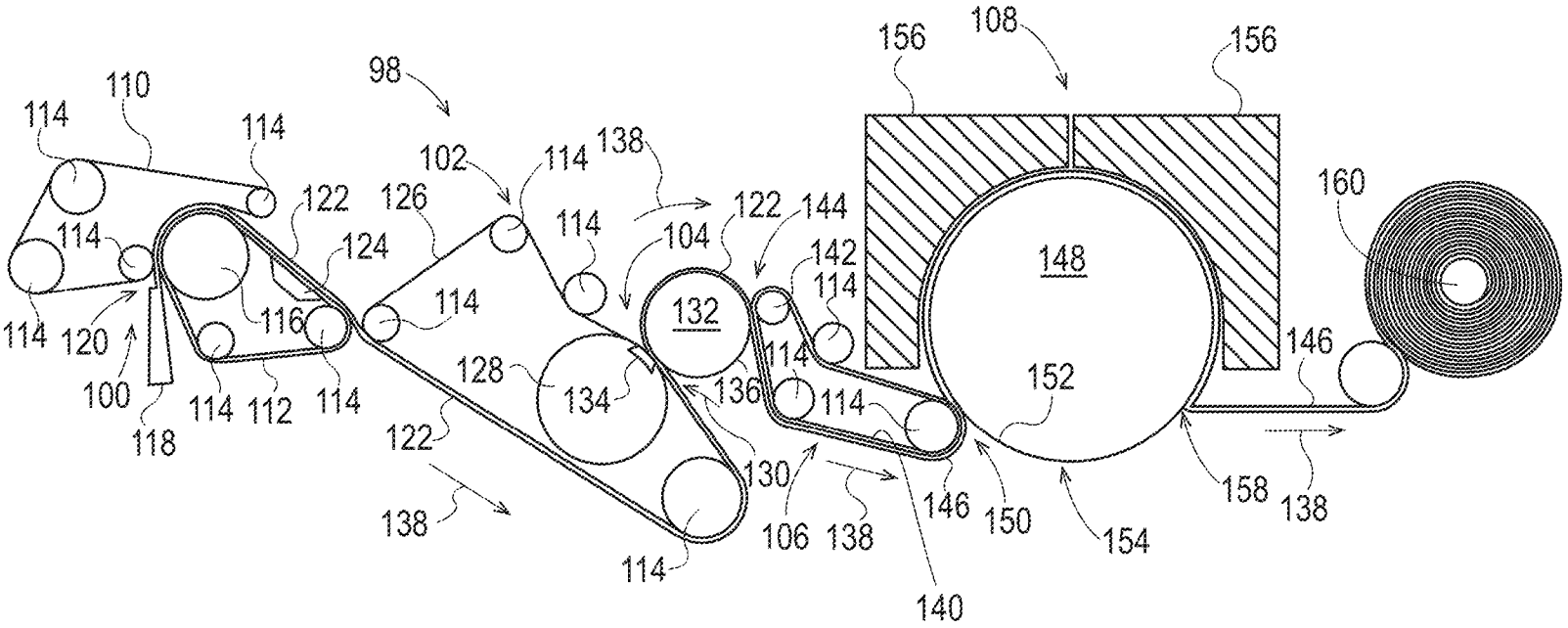
FIG. 5 is a schematic representation of an example of fabric creped papermaking process for making a sanitary tissue product according to the present invention.

Yet another example of a suitable papermaking process for making the sanitary tissue products of the present invention is illustrated in FIG. 5. FIG. 5 illustrates a papermaking machine 98 having a conventional twin wire forming section 100, a felt run section 102, a shoe press section 104, a molding member section 106, in this case a creping fabric section, and a Yankee dryer section 108 suitable for practicing the present invention. Forming section 100 includes a pair of forming fabrics 110 and 112 supported by a plurality of rolls 114 and a forming roll 116. A headbox 118 provides papermaking furnish to a nip 120 between forming roll 116 and roll 114 and the fabrics 110 and 112. The furnish forms an embryonic fibrous structure 122 which is dewatered on the fabrics 110 and 112 with the assistance of vacuum, for example, by way of vacuum box 124.

The embryonic fibrous structure 122 is advanced to a papermaking felt 126 which is supported by a plurality of rolls 114 and the felt 126 is in contact with a shoe press roll 128. The embryonic fibrous structure 122 is of low consistency as it is transferred to the felt 126. Transfer may be assisted by vacuum; such as by a vacuum roll if so desired or a pickup or vacuum shoe as is known in the art. As the embryonic fibrous structure 122 reaches the shoe press roll 128 it may have a consistency of 10-25% as it enters the shoe press nip 130 between shoe press roll 128 and transfer roll 132. Transfer roll 132 may be a heated roll if so desired. Instead of a shoe press roll 128, it could be a conventional suction pressure roll. If a shoe press roll 128 is employed it is desirable that roll 114 immediately prior to the shoe press roll 128 is a vacuum roll effective to remove water from the felt 126 prior to the felt 126 entering the shoe press nip 130 since water from the furnish will be pressed into the felt 126 in the shoe press nip 130. In any case, using a vacuum roll at the roll 114 is typically desirable to ensure the embryonic fibrous structure 122 remains in contact with the felt 126 during the direction change as one of skill in the art will appreciate from the diagram.

The embryonic fibrous structure 122 is wet-pressed on the felt 126 in the shoe press nip 130 with the assistance of pressure shoe 134. The embryonic fibrous structure 122 is thus compactively dewatered at the shoe press nip 130, typically by increasing the consistency by 15 or more points at this stage of the process. The configuration shown at shoe press nip 130 is generally termed a shoe press; in connection with the present invention transfer roll 132 is operative as a transfer cylinder which operates to convey embryonic fibrous structure 122 at high speed, typically 1000 feet/minute (fpm) to 6000 fpm to the patterned molding member section 106 of the present invention, for example a through-air-drying fabric section, also referred to in this process as a creping fabric section.

Transfer roll 132 has a smooth transfer roll surface 136 which may be provided with adhesive and/or release agents if needed. Embryonic fibrous structure 122 is adhered to transfer roll surface 136 which is rotating at a high angular velocity as the embryonic fibrous structure 122 continues to advance in the machine-direction indicated by arrows 138. On the transfer roll 132, embryonic fibrous structure 122 has a generally random apparent distribution of fiber. Embryonic fibrous structure 122 enters shoe press nip 130 typically at consistencies of 10-25% and is dewatered and dried to consistencies of from about 25 to about 70% by the time it is transferred to the molding member 140 according to the present invention, which in this case is a patterned creping fabric, as shown in the diagram.

Molding member 140 is supported on a plurality of rolls 114 and a press nip roll 142 and forms a molding member nip 144, for example fabric crepe nip, with transfer roll 132 as shown.

The molding member 140 defines a creping nip over the distance in which molding member 140 is adapted to contact transfer roll 132; that is, applies significant pressure to the embryonic fibrous structure 122 against the transfer roll 132. To this end, backing (or creping) press nip roll 142 may be provided with a soft deformable surface which will increase the length of the creping nip and increase the fabric creping angle between the molding member 140 and the embryonic fibrous structure 122 and the point of contact or a shoe press roll could be used as press nip roll 142 to increase effective contact with the embryonic fibrous structure 122 in high impact molding member nip 144 where embryonic fibrous structure 122 is transferred to molding member 140 and advanced in the machine-direction 138. By using different equipment at the molding member nip 144, it is possible to adjust the fabric creping angle or the takeaway angle from the molding member nip 144. Thus, it is possible to influence the nature and amount of redistribution of fiber, delamination/debonding which may occur at molding member nip 144 by adjusting these nip parameters. In some embodiments it may by desirable to restructure the z-direction interfiber characteristics while in other cases it may be desired to influence properties only in the plane of the fibrous structure. The molding member nip parameters can influence the distribution of fiber in the fibrous structure in a variety of directions, including inducing changes in the z-direction as well as the MD and CD. In any case, the transfer from the transfer roll to the molding member is high impact in that the fabric is traveling slower than the fibrous structure and a significant velocity change occurs. Typically, the fibrous structure is creped anywhere from 10-60% and even higher during transfer from the transfer roll to the molding member.

Molding member nip 144 generally extends over a molding member nip distance of anywhere from about ⅛" to about 2", typically ½" to 2". For a molding member 140, for example creping fabric, with 32 CD strands per inch, embryonic fibrous structure 122 thus will encounter anywhere from about 4 to 64 weft filaments in the molding member nip 144.

The nip pressure in molding member nip 144, that is, the loading between roll 142 and transfer roll 132 is suitably 20-100 pounds per linear inch (PLI).

After passing through the molding member nip 144, and for example fabric creping the embryonic fibrous structure 122, a 3D patterned fibrous structure 146 continues to advance along MD 138 where it is wet-pressed onto Yankee cylinder (dryer) 148 in transfer nip 150. Transfer at nip 150 occurs at a 3D patterned fibrous structure 146 consistency of generally from about 25 to about 70%. At these consistencies, it is difficult to adhere the 3D patterned fibrous structure 146 to the Yankee cylinder surface 152 firmly enough to remove the 3D patterned fibrous structure 146 from the molding member 140 thoroughly. This aspect of the process is important, particularly when it is desired to use a high velocity drying hood as well as maintain high impact creping conditions.

In this connection, it is noted that conventional TAD processes do not employ high velocity hoods since sufficient adhesion to the Yankee dryer is not achieved.

It has been found in accordance with the present invention that the use of particular adhesives cooperate with a moderately moist fibrous structure (25-70% consistency) to adhere it to the Yankee dryer sufficiently to allow for high velocity operation of the system and high jet velocity impingement air drying. In this connection, a poly(vinyl alcohol)/polyamide adhesive composition as noted above is applied at 154 as needed.

The 3D patterned fibrous structure is dried on Yankee cylinder 148 which is a heated cylinder and by high jet velocity impingement air in Yankee hood 156. As the Yankee cylinder 148 rotates, 3D patterned fibrous structure 146 is creped from the Yankee cylinder 148 by creping doctor blade 158 and wound on a take-up roll 160. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of tissue products. In general, tissue products creped using an undulatory blade have higher caliper (thickness), increased CD stretch, and a higher void volume than do comparable tissue products produced using conventional crepe blades. All of these changes affected by the use of the undulatory blade tend to correlate with improved softness perception of the tissue products.

When a wet-crepe process is employed, an impingement air dryer, a through-air dryer, or a plurality of can dryers can be used instead of a Yankee. Impingement air dryers are disclosed in the following patents and applications, the disclosure of which is incorporated herein by reference: U.S. Pat. No. 5,865,955 of Ilvespaaet et al. U.S. Pat. No. 5,968,590 of Ahonen et al. U.S. Pat. No. 6,001,421 of Ahonen et al. U.S. Pat. No. 6,119,362 of Sundqvist et al. U.S. patent application Ser. No. 09/733,172, entitled Wet Crepe, Impingement-Air Dry Process for Making Absorbent Sheet, now U.S. Pat. No. 6,432,267. A throughdrying unit as is well known in the art and described in U.S. Pat. No. 3,432,936 to Cole et al., the disclosure of which is incorporated herein by reference as is U.S. Pat. No. 5,851,353 which discloses a can-drying system.

Figure 6:
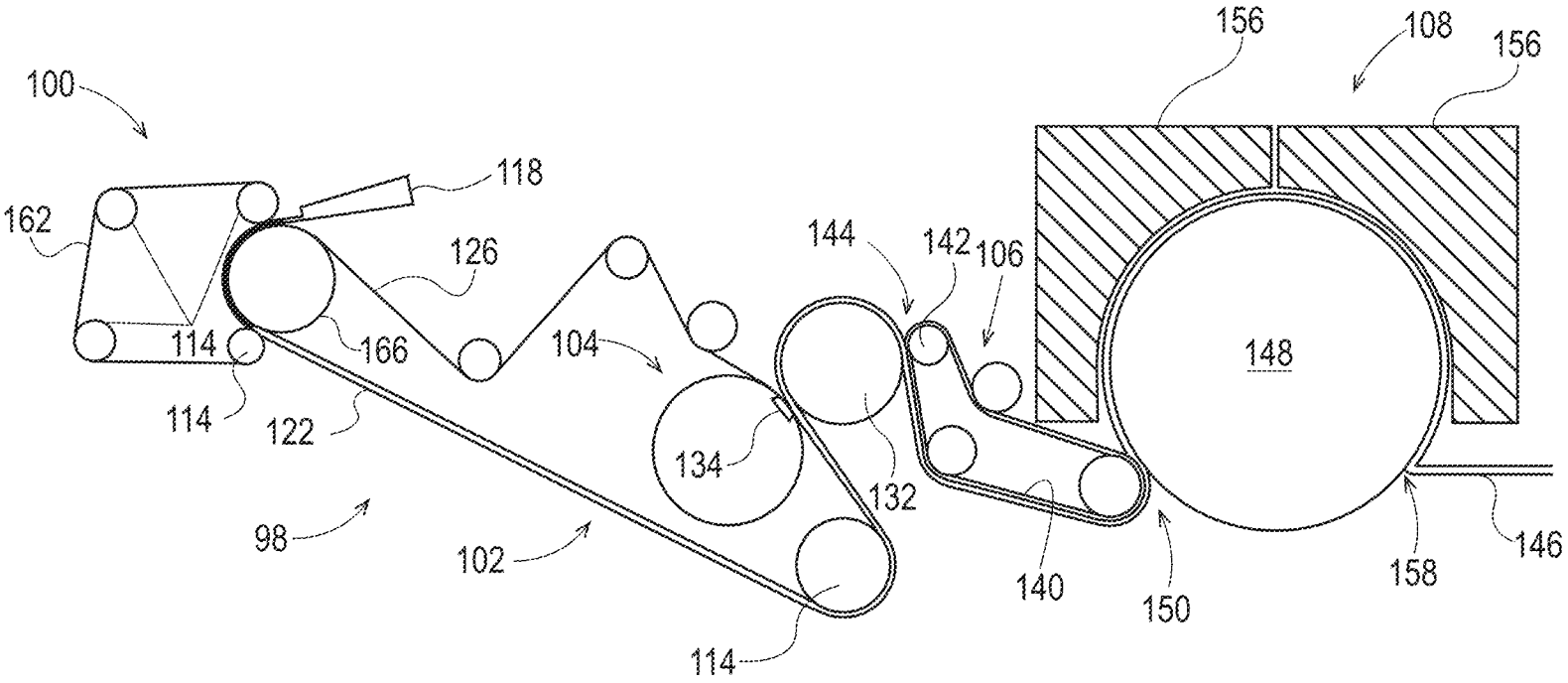
FIG. 6 is a schematic representation of another example of a fabric creped papermaking process for making a sanitary tissue product according to the present invention.

There is shown in FIG. 6 a papermaking machine 98, similar to FIG. 6, for use in connection with the present invention. Papermaking machine 98 is a three fabric loop machine having a forming section 100 generally referred to in the art as a crescent former. Forming section 100 includes a forming wire 162 supported by a plurality of rolls such as rolls 114. The forming section 100 also includes a forming roll 166 which supports paper making felt 126 such that embryonic fibrous structure 122 is formed directly on the felt 126. Felt run 102 extends to a shoe press section 104 wherein the moist embryonic fibrous structure 122 is deposited on a transfer roll 132 (also referred to sometimes as a backing roll) as described above. Thereafter, embryonic fibrous structure 122 is creped onto molding member 140, such as a crepe fabric, in molding member nip 144 before being deposited on Yankee dryer 148 in another press nip 150. The papermaking machine 98 may include a vacuum turning roll, in some embodiments; however, the three loop system may be configured in a variety of ways wherein a turning roll is not necessary. This feature is particularly important in connection with the rebuild of a papermachine inasmuch as the expense of relocating associated equipment i.e. pulping or fiber processing equipment and/or the large and expensive drying equipment such as the Yankee dryer or plurality of can dryers would make a rebuild prohibitively expensive unless the improvements could be configured to be compatible with the existing facility.

Figure 7:
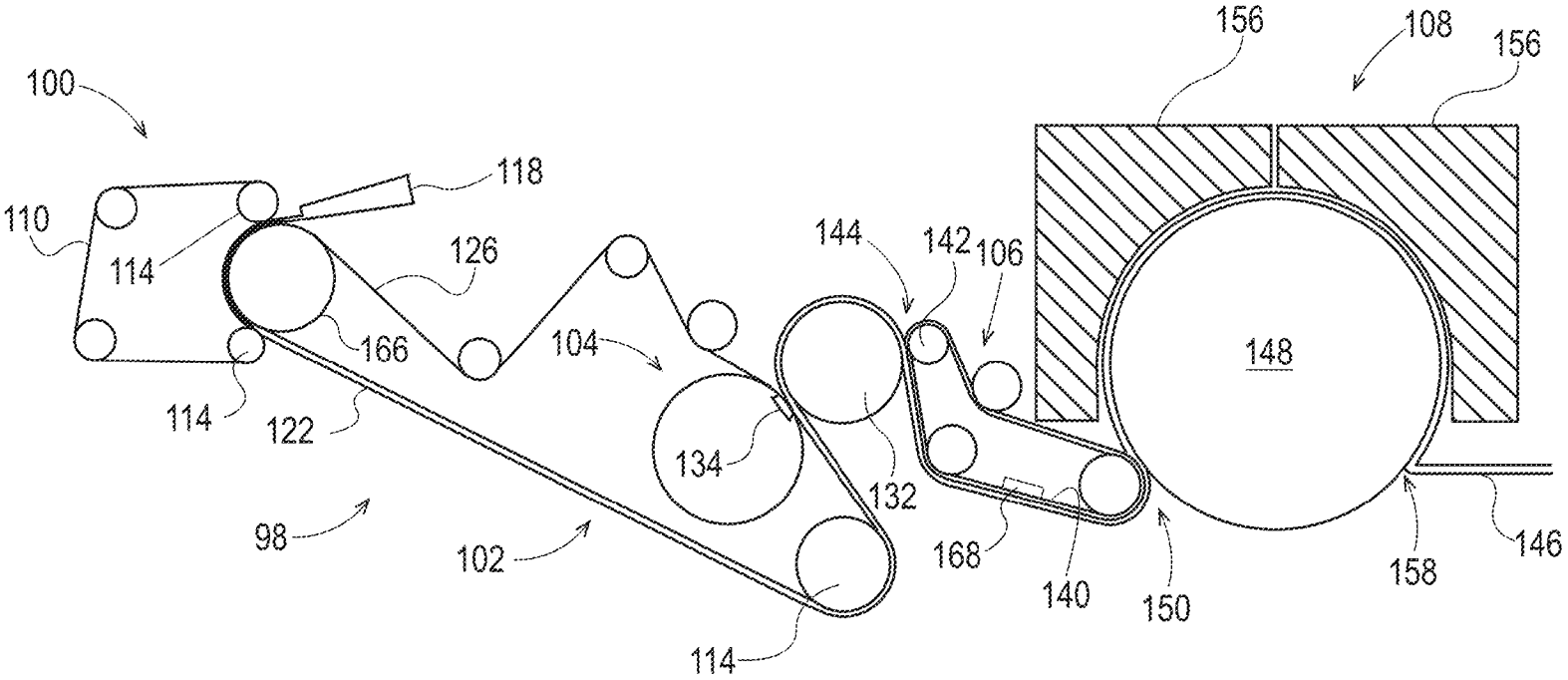
FIG. 7 is a schematic representation of an example of belt creped papermaking process for making a sanitary tissue product according to the present invention.

FIG. 7 shows another example of a suitable papermaking process to make the sanitary tissue products of the present invention. FIG. 7 illustrates a papermaking machine 98 for use in connection with the present invention. Papermaking machine 98 is a three fabric loop machine having a forming section 100, generally referred to in the art as a crescent former. Forming section 100 includes headbox 118 depositing a furnish on forming wire 110 supported by a plurality of rolls 114. The forming section 100 also includes a forming roll 166, which supports papermaking felt 126, such that embryonic fibrous structure 122 is formed directly on felt 126. Felt run 102 extends to a shoe press section 104 wherein the moist embryonic fibrous structure 122 is deposited on a transfer roll 132 and wet-pressed concurrently with the transfer. Thereafter, embryonic fibrous structure 122 is transferred to the molding member section 106, by being transferred to and/or creped onto molding member 140 of the present invention, for example a through-air-drying belt, in molding member nip 144, for example belt crepe nip, before being optionally vacuum drawn by suction box 168 and then deposited on Yankee dryer 148 in another press nip 150 using a creping adhesive, as noted above. Transfer to a Yankee dryer from the creping belt differs from conventional transfers in a conventional wet press (CWP) from a felt to a Yankee. In a CWP process, pressures in the transfer nip may be 500 PLI (87.6 kN/meter) or so, and the pressured contact area between the Yankee surface and the fibrous structure is close to or at 100%. The press roll may be a suction roll which may have a P&J hardness of 25-30. On the other hand, a belt crepe process of the present invention typically involves transfer to a Yankee with 4-40% pressured contact area between the fibrous structure and the Yankee surface at a pressure of 250-350 PLI (43.8-61.3 kN/meter). No suction is applied in the transfer nip, and a softer pressure roll is used, P&J hardness 35-45. The papermaking machine may include a suction roll, in some embodiments; however, the three loop system may be configured in a variety of ways wherein a turning roll is not necessary. This feature is particularly important in connection with the rebuild of a papermachine inasmuch as the expense of relocating associated equipment, i.e., the headbox, pulping or fiber processing equipment and/or the large and expensive drying equipment, such as the Yankee dryer or plurality of can dryers, would make a rebuild prohibitively expensive, unless the improvements could be configured to be compatible with the existing facility.

NON-LIMITING EXAMPLES OF METHODS FOR MAKING SANITARY TISSUE PRODUCTS

Example 1

Through-Air-Drying Belt

The following Example illustrates a non-limiting example for a preparation of a sanitary tissue product comprising a fibrous structure according to the present invention on a pilot-scale Fourdrinier fibrous structure making (papermaking) machine.

An aqueous slurry of eucalyptus (Fibria Brazilian bleached hardwood kraft pulp) pulp fibers is prepared at about 3% fiber by weight using a conventional repulper, then transferred to the hardwood fiber stock chest. The eucalyptus fiber slurry of the hardwood stock chest is pumped through a stock pipe to a hardwood fan pump where the slurry consistency is reduced from about 3% by fiber weight to about 0.15% by fiber weight. The 0.15% eucalyptus slurry is then pumped and equally distributed in the top and bottom chambers of a multi-layered, three-chambered headbox of a Fourdrinier wet-laid papermaking machine.

Additionally, an aqueous slurry of NSK (Northern Softwood Kraft) pulp fibers is prepared at about 3% fiber by weight using a conventional repulper, then transferred to the softwood fiber stock chest. The NSK fiber slurry of the softwood stock chest is pumped through a stock pipe to be refined to a Canadian Standard Freeness (CSF) of about 630. The refined NSK fiber slurry is then directed to the NSK fan pump where the NSK slurry consistency is reduced from about 3% by fiber weight to about 0.15% by fiber weight. The 0.15% eucalyptus slurry is then directed and distributed to the center chamber of a multi-layered, three-chambered headbox of a Fourdrinier wet-laid papermaking machine.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The wet-laid papermaking machine has a layered headbox having a top chamber, a center chamber, and a bottom chamber where the chambers feed directly onto the forming wire (Fourdrinier wire). The eucalyptus fiber slurry of 0.15% consistency is directed to the top headbox chamber and bottom headbox chamber. The NSK fiber slurry is directed to the center headbox chamber. All three fiber layers are delivered simultaneously in superposed relation onto the Fourdrinier wire to form thereon a three-layer embryonic fibrous structure (web), of which about 33% of the top side is made up of the eucalyptus fibers, about 33% is made of the eucalyptus fibers on the bottom side and about 34% is made up of the NSK fibers in the center. Dewatering occurs through the Fourdrinier wire and is assisted by a deflector and wire table vacuum boxes. The Fourdrinier wire is an 84M (84 by 76 5A, Albany International). The speed of the Fourdrinier wire is about 800 feet per minute (fpm).

The embryonic wet fibrous structure is transferred from the Fourdrinier wire, at a fiber consistency of about 16-20% at the point of transfer, to a 3D patterned through-air-drying belt as shown in FIGS. 1A-1C. The speed of the 3D patterned through-air-drying belt is the same as the speed of the Fourdrinier wire. The 3D patterned through-air-drying belt is designed to yield a fibrous structure as shown in FIGS. 2A-2D comprising a pattern of semi-continuous low density pillow regions and semi-continuous high density knuckle regions. This 3D patterned through-air-drying belt is formed by casting an impervious resin surface onto a fiber mesh supporting fabric as shown in FIGS. 1B and 1C. The supporting fabric is a 98×52 filament, dual layer fine mesh. The thickness of the resin cast is about 13 mils above the supporting fabric.

Further de-watering of the fibrous structure is accomplished by vacuum assisted drainage until the fibrous structure has a fiber consistency of about 20% to 30%.

While remaining in contact with the 3D patterned through-air-drying belt, the fibrous structure is pre-dried by air blow-through pre-dryers to a fiber consistency of about 50-65% by weight.

After the pre-dryers, the semi-dry fibrous structure is transferred to a Yankee dryer and adhered to the surface of the Yankee dryer with a sprayed creping adhesive. The creping adhesive is an aqueous dispersion with the actives consisting of about 80% polyvinyl alcohol (PVA 88-50), about 20% CREPETROL® 457T20. CREPETROL® 457T20 is commercially available from Ashland (formerly Hercules Incorporated of Wilmington, Del.). The creping adhesive is delivered to the Yankee surface at a rate of about 0.15% adhesive solids based on the dry weight of the fibrous structure. The fiber consistency is increased to about 97% before the fibrous structure is dry-creped from the Yankee with a doctor blade.

The doctor blade has a bevel angle of about 25° and is positioned with respect to the Yankee dryer to provide an impact angle of about 81°. The Yankee dryer is operated at a temperature of about 275° F. and a speed of about 800 fpm. The fibrous structure is wound in a roll (parent roll) using a surface driven reel drum having a surface speed of about 695 fpm.

Two parent rolls of the fibrous structure are then converted into a sanitary tissue product by loading the roll of fibrous structure into an unwind stand. The line speed is 400 ft/min. One parent roll of the fibrous structure is unwound and transported to an emboss stand where the fibrous structure is strained to form the emboss pattern in the fibrous structure and then combined with the fibrous structure from the other parent roll to make a multi-ply (2-ply) sanitary tissue product. The multi-ply sanitary tissue product is then transported over a slot extruder through which a surface chemistry may be applied. The multi-ply sanitary tissue product is then transported to a winder where it is wound onto a core to form a log. The log of multi-ply sanitary tissue product is then transported to a log saw where the log is cut into finished multi-ply sanitary tissue product rolls. The multi-ply sanitary tissue product of this example exhibits the inventive properties shown in Table 1, above.

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 2 hours prior to the test. The samples tested are "usable units." "Usable units" as used herein means sheets, flats from roll stock, pre-converted flats, and/or single or multi-ply products. All tests are conducted in such conditioned room. Do not test samples that have defects such as wrinkles, tears, holes, and like. All instruments are calibrated according to manufacturer's specifications.

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

Basis Weight=(Mass of stack)/[(Area of 1 square in stack)×(No. of squares in stack)]

For example, $$\text{Basis Weight}(\text{lbs}/3000\ \text{ft}^2)=\text{Mass of stack}(\text{g})/453.6(\text{g}/\text{lbs})]/[12.25(\text{in}^2)/144\ (\text{in}^2/\text{ft}^2)\times 12]]\times 3000$$

or, $$\text{Basis Weight}(\text{g}/\text{m}^2)=\text{Mass of stack}(\text{g})/[79.032(\text{cm}^2)/10{,}000(\text{cm}^2/\text{m}^2)\times 12]$$

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Caliper Test Method

Caliper of a fibrous structure and/or sanitary tissue product is measured using a ProGage Thickness Tester (Thwing-Albert Instrument Company, West Berlin, N.J.) with a pressure foot diameter of 2.00 inches (area of 3.14 in2) at a pressure of 95 g/in2. Four (4) samples are prepared by cutting of a usable unit such that each cut sample is at least 2.5 inches per side, avoiding creases, folds, and obvious defects. An individual specimen is placed on the anvil with the specimen centered underneath the pressure foot. The foot is lowered at 0.03 in/sec to an applied pressure of 95 g/in2. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Density Test Method

The density of a fibrous structure and/or sanitary tissue product is calculated as the quotient of the Basis Weight of a fibrous structure or sanitary tissue product expressed in lbs/3000 ft2 divided by the Caliper (at 95 g/in2) of the fibrous structure or sanitary tissue product expressed in mils. The final Density value is calculated in lbs/ft3 and/or g/cm3, by using the appropriate converting factors.

Lint Test Method i. Sample Preparation—Sample strips (a total of 4 if testing both sides, 2 if testing a single side) of fibrous structures and/or sanitary tissue products, which do not have abraded portions) 11.43 cm (4.5 inch) wide×30.48 cm to 40.64 cm (12-16 inch) long such that each sample strip can be folded upon itself to form a 11.43 cm (4.5 inch) wide (CD) by 10.16 cm (4.0 inch) long (MD) rectangular implement having a total basis weight of between 140 to 200 $g/m^2$ are obtained and conditioned according to Tappi Method #T4020M-88. For both side testing, makeup two rectangular implements as described above with a first side out and then two rectangular implements with the other side out (keep track of which are which).

For sanitary tissue products formed from multiple plies of fibrous structure, this test can be used to make a lint measurement on the multi-ply sanitary tissue product, or, if the plies can be separated without damaging the sanitary tissue product, a measurement can be taken on the individual plies making up the sanitary tissue product. If a given sample differs from surface to surface, it is necessary to test both surfaces and average the scores in order to arrive at a composite lint score. In some cases, sanitary tissue products are made from multiple-plies of fibrous structures such that the facing-out surfaces are identical, in which case it is only necessary to test one surface.

Each sample is folded upon itself to make a 4.5" CD×4" MD sample. For two-surface testing, make up 3 (4.5" CD×4" MD) samples with a first surface "out" and 3 (4.5" CD×4" MD) samples with the second surface "out". Keep track of which samples are first surface "out" and which are second surface "out".

For a dry lint test, obtain a 30"×40" piece of Crescent #300 cardboard from Cordage Inc. (800 E. Ross Road, Cincinnati, Ohio, 45217) or equivalent. Using a paper cutter, cut out six pieces of cardboard of dimensions of 6.35 cm×15.24 cm (2.5 inch×6 inch). Puncture two holes into each of the six pieces of cardboard by forcing the cardboard onto the hold down pins of the Sutherland Rub tester. Center and carefully place each of the cardboard pieces on top of the previously folded samples with the tested side exposed outward. Make sure the 15.24 cm (6 inch) dimension of the cardboard is running parallel to the machine direction (MD) of each of the folded samples. Fold one edge of the exposed portion of the sample onto the back of the cardboard. Secure this edge to the cardboard with adhesive tape obtained from 3M Inc. (¾" wide Scotch Brand, St. Paul, Minn.) or equivalent. Carefully grasp the other over-hanging tissue edge and snugly fold it over onto the back of the cardboard. While maintaining a snug fit of the sample onto the cardboard, tape this second edge to the back of the cardboard. Repeat this procedure for each sample. Turn over each sample and tape the cross direction edges of the sample to the cardboard. One half of the adhesive tape should contact the sample while the other half is adhering to the cardboard. Repeat this procedure for each of the samples. If the sample breaks, tears, or becomes frayed at any time during the course of this sample preparation procedure, discard and make up a new sample with a sample strip.

ii. Felt and Weight Component Preparation—Cut a piece of a black test felt (F-55 or equivalent from New England Gasket, 550 Broad Street, Bristol, Conn. 06010) to the dimensions of 2¼"×7¼". The felt is to be used in association with a weight. The weight may include a clamping device to attach the felt/cardboard combination to the weight. The weight and any clamping device total five (5) pounds. The weight is available from Danilee Company, San Antonio, Tex., and is associated with the Sutherland Rub Tester. The weight has a 2" ×4" piece of smooth surface foam attached to its contact face (⅛" thick, Poron quick Recovery Foam, adhesive back, firmness rating 13). For the dry test, the felt is clamped directly against this foam surface, providing an effective contact area of 8 $in^2$ and a contact pressure of about 0.625 psi. For the wet test, an additional 1"×4" foam strip (same foam as described above) is attached and centered in the length direction on top the 2"×4" foam strip, thus, after clamping the felt against this surface, an effective contact area of 4 $in^2$ and a contact pressure of about 1.25 psi is established. Also, for the wet test only, after clamping the felt to weight apparatus, two strips of tape (4¼"-5¼" in length, Scotch brand ¾" width) are placed along each edge of the felt (parallel to the long side of the felt) on the felt side that will be contacting the sample. The untaped felt between the two tape strips has a width between 18-21 mm. Three marks are placed on one of the strips of tape at 0, 4 and 10 centimeters along the flat, test region of the test felt.

iii. Conducting Dry Lint Test—The amount of dry lint and/or dry pills generated from a fibrous product according to the present invention is determined with a Sutherland Rub Tester (available from Danilee Company, San Antonio, Tex.). This tester uses a motor to rub a felt/weight component 5 times (back and forth) over the fibrous product, while the fibrous product is restrained in a stationary position.

First, turn on the Sutherland Rub Tester pressing the "reset" button. Set the tester to run 5 strokes at the lower of the two speeds. One stroke is a single and complete forward and reverse motion of the weight. The end of the rubbing block should be in the position closest to the operator at the beginning and at the end of each test.

Place the sample/cardboard combination on the base plate of the tester by slipping the holes in the board over the hold-down pins. The hold-down pins prevent the sample from moving during the test. Hook the felt/weight combination into the tester arm of the Sutherland Rub Tester, and gently place it on top of the sample/cardboard combination. The felt must rest level on the calibration sample and must be in 100% contact with the calibration sample surface (use a bubble level indicator to verify). Activate the Sutherland Rub Tester by pressing the "start" button.

Keep a count of the number of strokes and observe and make a mental note of the starting and stopping position of the felt covered weight in relationship to the sample. If the total number of strokes is five and if the position of the calibration felt covered weight is the same at the end as it was in the beginning of the test, the test was successful performed. If the total number of strokes is not five or if the start and end positions of the felt covered weight are different, then the instrument may require servicing and/or recalibration.

Once the instrument is finished moving, remove the felt covered weight from the holding arm of the instrument, and unclamp the felt from the weight. Lay the test felt on a clean, flat surface.

The next step is to complete image capture, analysis, and calculations on the test felts as described below.

vi. Image Capture—The images of the felt (untested), sample (untested) and felt (tested) are captured using a computer and scanner (Microtek ArtixScan 1800f). Be certain that scanner glass is clear and clean. Place felts centered on scanner, face down. Adjust image capture boundaries so that all felts are included into the captured image. Set-up the scanner to 600 dpi, RGB, and 100% image size (no scaling). After successfully imaging the felts, save the image as an 8-bit RGB TIFF image, remove felts from scanner, and repeat from process until all felts images are captured.

Additional images of the sample (untested) may need to be captured (in the same manner) if they have an average luminance (using Optimas software) significantly less than 254 (less than 244), after being converted to an 8-bit gray-scale image. Also, an image of a known length standard (e.g., a ruler) is taken (exposure difference does not matter for this image). This image is used to calibrate the image analysis software distance scale.

vii. Image Analysis—The images captured are analyzed using Optimas 6.5 Image Analysis software commercially available from Media Cybernetics, L.P. Imaging set-up parameters, as listed herein, must be strictly adhered to in order to have meaningfully comparative lint score and pill score results.

First, an image with a known length standard (e.g., a ruler) is brought up in Optimas, and used to calibrate length units (millimeters in this case). For dry testing, the region of interest (ROI) area is approximately 4500 mm2 (90 mm by 50 mm), and the wetted and dragged ROI area is approximately 1500 mm2 (94 mm by 16 mm). The exact ROI area is measured and recorded (variable name: ROI area). The average gray value of the unrubbed region of the test felt is used as the baseline, and is recorded for determining the threshold and lint values (variable name: untested felt GV avg). It is determined by creating a region of interest box (ROI) with dimensions approximately 5 mm by 25 mm on the untested, unrubbed area of the black felt, on opposite ends of the rubbed region. The average of these two average gray value luminaces for each of the ROI's is used as the untested felt GV average value for that particular test felt. This is repeated for all test felts analyzed. The test sheet luminance is typically near saturated white (gray value 254) and fairly constant for samples of interest. If believed to be different, measure the test sheet in a similar fashion as was done for the untested felt, and record (variable name=untested sheet GV avg). The luminance threshold is calculated based on the untested felt GV avg and untested sheet GV avg as follows:

For the dry lint/pilling test felts:

(untested_sheet_GV_avg−untested_felt_GV_avg)*0.4+untested_felt_GV_avg

For the wet lint/pilling test felts:

(untested_sheet_GV_avg−untested_felt_GV_avg)*0.25+untested_felt_GV_avg

The test felt image is opened, and the ROI and its boundaries are created and properly positioned to encompass a region that completely contains pills and contains the highest concentration of pills on the rubbed section of the test felt. The average luminance for the ROI is recorded (variable name: ROI GV avg). Pills are determined as follows: Optimas creates boundary lines in the image where pixel luminance values cross through the threshold value (e.g., if the threshold is 120, boundary lines are created where pixels of higher and lower value exist on either side. The criteria for determining a pill is that it must have an average luminance greater than the threshold value, and have a perimeter length greater than 0.5 mm. The sum of the pilled areas variable name is: Total Pilled Area.

Measurement data of the ROI, and for each pill is exported from Optimas to a spreadsheet for performing the following calculations.

viii. Calculations—The data obtained from the image analysis is used in the following calculations:

Pilled Area %=Percent of area covered by pilling=Total Pilled Area/ROI area

Lint Score=Gray value difference between unpilled area of the rubbed test felt area and the untested felt Lint Score=unpilled felt Gray Value avg−untested felt Gray Value avg where: unpilled felt Gray Value avg=[(ROI Gray Value avg*ROI area)−(pilled Gray Value avg*pilled area)]/Total Unpilled Area By taking the average of the lint score of the first-side surface and the second-side surface, the lint is obtained which is applicable to that particular web or product. In other words, to calculate lint score, the following formula is used:

$$\text{Dry Lint Score} = \frac{\text{Dry Lint Score, } 1^{st} \text{ side} + \text{Dry Lint Score, } 2^{nd} \text{ side}}{2}$$

$$\text{Dry Pill Area \%} = \frac{\text{Dry Pill Area \%, } 1^{st} \text{ side} + \text{Dry Pill Area \%, } 2^{nd} \text{ side}}{2}$$

Free Fiber Test Method

An apparatus and method for quantifying the number of fibers emanating from a surface (also used interchangeably with "free fiber measurement system" and "free fiber measurement" respectively herein) as well as the effective height of fibers emanating from a surface (also used interchangeably with "effective fiber height" herein) can utilize an image gathering apparatus to configure a web substrate such as a facial tissue, bath tissue, paper toweling, paper napkins, as well as other substrates on a suitable image scanner in order generate an image file. The image gathering apparatus is preferably capable of providing a scanned image of the web substrate. The method described herein can then use software to measure the number of free fibers emanating from the surface along a length of tissue and the average effective free fiber height from the recorded image(s). The free fiber measurement system generally includes a testing apparatus, an imaging system, and computer-based image analysis software.

Test Apparatus

Figure 8:
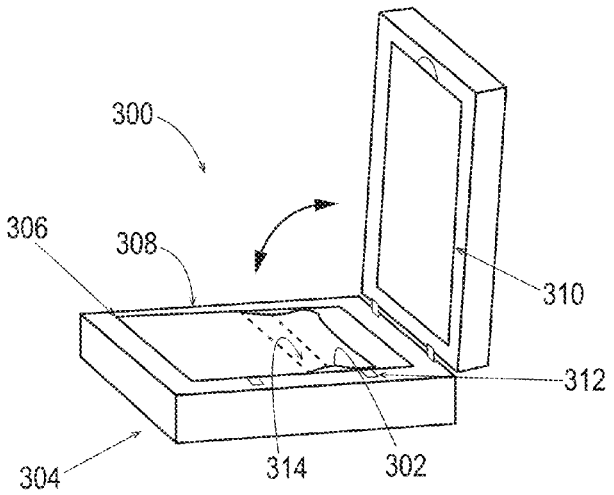
FIG. 8 is an exemplary rendering of an apparatus suitable for generating an image file suitable for use with the current invention.

Referring to FIG. 8, an exemplary and non-limiting image gathering apparatus 300 suitable for use to create an image of the fibers extending from the surface of a sanitary tissue product and/or fibrous structure 302 (i.e., Z-direction fibers) along the length and/or width of a sanitary tissue product and/or fibrous structure 302 can generally comprise the following equipment:

(1) Image scanner 304—one of skill in the art will recognize that virtually any image scanner 304 capable of creating an image file suitable for the method of the present invention is suitable for the purposes of the present invention. For purposes of this disclosure, an exemplary but non-limiting suitable image scanner 304 is an Epson Perfection V 700 Photo. The scanner selected should be capable of providing an image with a resolution of at least about 50 dpi, or at least about 300 dpi, or at least about 1200 dpi, or at least about 9600 dpi. The flat bed desktop digital image scanner 304 mentioned herein can be provided with the following specifications:
Document Type: Reflective
Document Source: Document Table
Auto Exposure Type: Photo
Image Type: 16-bit Gray scale
Resolution: 2400 dpi
Adjustments: Unsharp Mask (ON, Level=High)
Dust removal (On, Level=High)

Further details of the image scanner 304 are discussed infra.

(2) Sample holder 306—one of skill in the art will recognize that sample holder 306 is used to position a suitably prepared sanitary tissue product and/or fibrous structure 302 on the image scanner bed 308. The exemplary sample holder 306 positions the sanitary tissue product and/or fibrous structure 302 upon the image scanner bed 308 in order to facilitate the image scanner 304 creating an image of fibers extending from the sanitary tissue product and/or fibrous structure 302 in the Z-direction. Further details of the sample holder 306 are discussed infra.

(3) A reflection minimizing insert 310—further details of the reflection minimizing insert 310 are discussed infra.

It should be realized by one of skill in the art that each component of the sample holder 306 can be made with any suitable material, however, it is desirable that each component is constructed from materials made using Fused Deposition Modeling (FDM) technology The sample holder 306 is generally formed from two portions: a sample holder frame 312 and the substrate holder 314. The sample holder frame 312 is designed to permit the precise and repeatable placement of the sample holder 306 on the image scanner bed 308 of the image scanner 304. The sample holder frame 312, which is desirably removable, attaches to the image scanner bed 308. One of skill in the art could provide such releasable attachment by the placement of notches, detents, guides, and the like positioned upon the image scanner bed 308 or the image scanner 304.

The substrate holder 314 is generally configured to provide the sanitary tissue product and/or fibrous structure 302 with suitable and/or adequate tension. It was also found that the substrate holder 314 can also position the sanitary tissue product and/or fibrous structure 302 into a fixed position within the sample holder 306 and the resulting substrate holder 314 positioned relative to the image scanner bed 308 in a consistent manner to facilitate imaging of the fibers extending from the sanitary tissue product and/or fibrous structure 302 in the Z-direction along the length of the sanitary tissue product and/of fibrous structure 302.

Figure 9:
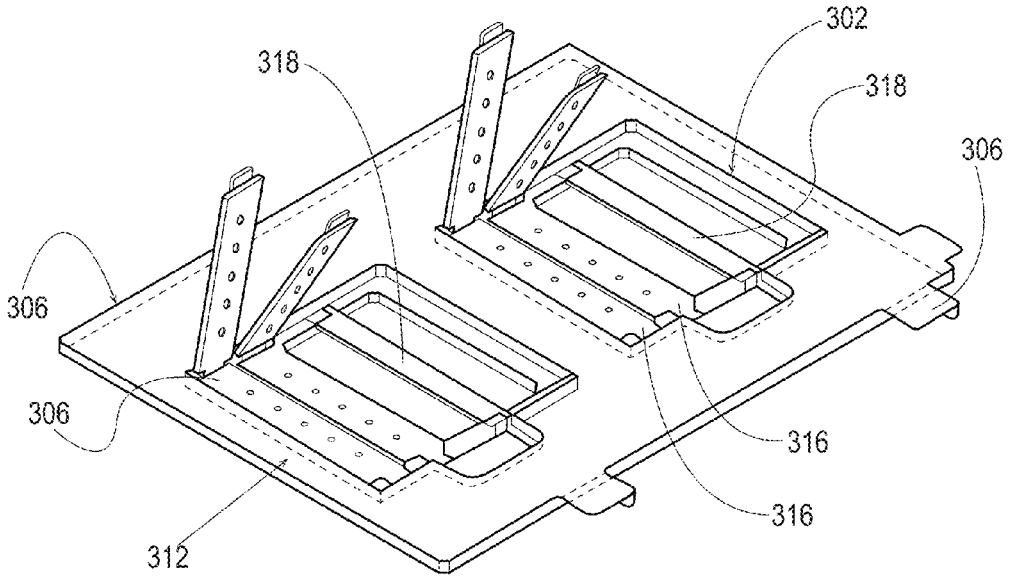
FIG. 9 is an exemplary rendering of a frame and removable holder suitable for holding a product such as a web substrate suitable for use with the current invention.

Referring to FIG. 9, the sample holder frame 312 desirably and generally comprises two press-fit latches 316 that are used to secure the sanitary tissue product and/or fibrous structure 302 once it has been looped over a shim 318. By way of non-limiting example, shim 318 can be provided as a thin metal bar. A suitable shim 318 for use with a single user unit thickness of bath tissue and facial tissue, independent of the number of plies, was found to have a thickness of about 0.064 cm.

Referring again to FIG. 8, reflection minimizing insert 310 can be designed to minimize any background reflection from the image scanner 304 glass top caused by the scanner light and can also provide a contrasting background to assist in the analysis of the sanitary tissue product and/or fibrous structure 302. In a desirable embodiment, the reflection minimizing insert 310 is formed by a process utilizing fused deposition modeling (FDM) and is attached to the notches typically found on top section of the chosen scanner. It should be readily realized that the reflection minimizing insert 310 can be designed and formed using any process available. One of skill in the art will understand that it would be advantageous to provide the reflection minimizing insert 310 as a black felt material. Additionally, one of skill in the art will recognize that reflection minimizing insert 310 maybe attached or provided as unattached to the top section of the scanner. For example, the reflection minimizing insert 310 can be placed directly onto the sample holder frame 312 before or after the sample holder frame 312 is placed in position for scanning by image scanner 304.

Experimental Protocol

For the exemplary method described herein, each sample of sanitary tissue product and/or fibrous structure 302 is prepared for testing according to the following process:

The sanitary tissue product and/or fibrous structure 302 to be tested (by way of non-limiting example, bath tissue) is cut to a length of at least 20 cm, which may include perforations present within the sanitary tissue product and/or fibrous structure, for example, the sample may be a part of 2 or more contiguous (but perforated) sheets within the sanitary tissue product and/or fibrous structure 302, its width being equal to the standard user unit of the sanitary tissue product and/or fibrous structure 302 to form a sample for testing. If the sample is not already conditioned as described above, then the sample is conditioned at a temperature of 23° C.±1.0° C. and a relative humidity of 50%±2% for a minimum of 2 hours prior to testing.

The sample is placed on the sample holder frame 312 such that it loops over the shim 318 in either the MD or CD of the sanitary tissue product and/or fibrous structure 302. The region over the shim 318 is desirably not the perforated region of the sanitary tissue product and/or fibrous structure 302 (generally disposed in the CD) or an edge of the sanitary tissue product and/or fibrous structure 302 (generally in the MD) as these regions may not be representative of the remainder of the sample that has not been subjected to a mechanical cutting, slitting, and/or perforating appara =10.6 cm, width=1.35 cm, and thickness 0.064 cm. Desirably, the sample is positioned over shim 318 and positioned within sample holder frame 312 so that the length of sample disposed on both sides of shim 318 are approximately equal.

Figure 11:
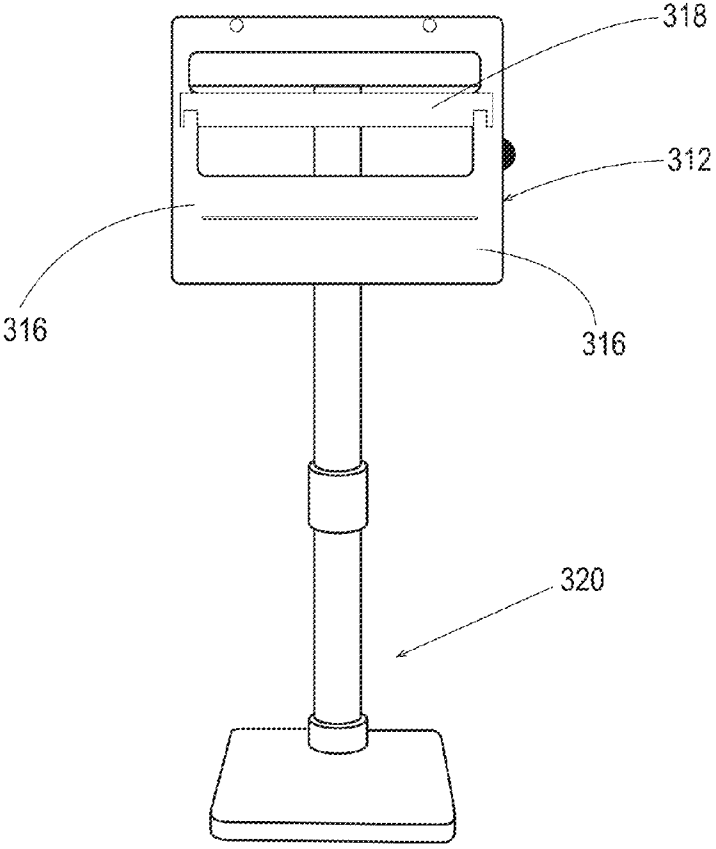
FIG. 11 is an exemplary rendering of the stand of FIG. 10 with an exemplary holder suitable for use with the current invention.
Figure 10:
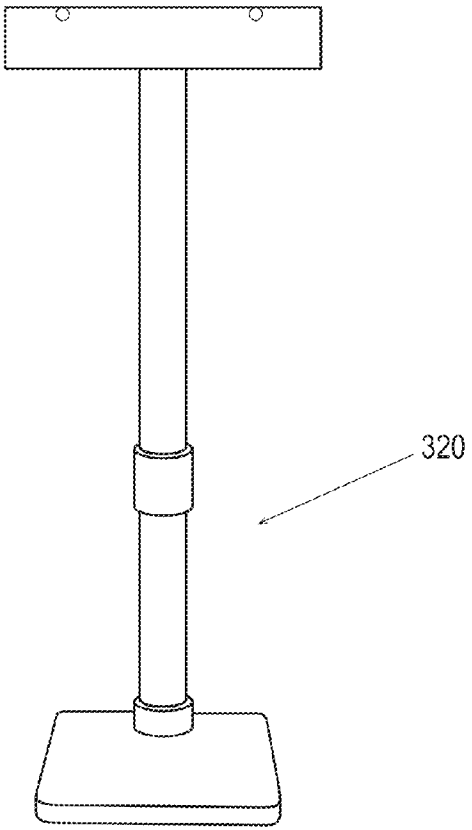
FIG. 10 is an exemplary rendering of a stand suitable for holding a holder suitable for use with the current invention.
Figure 12:
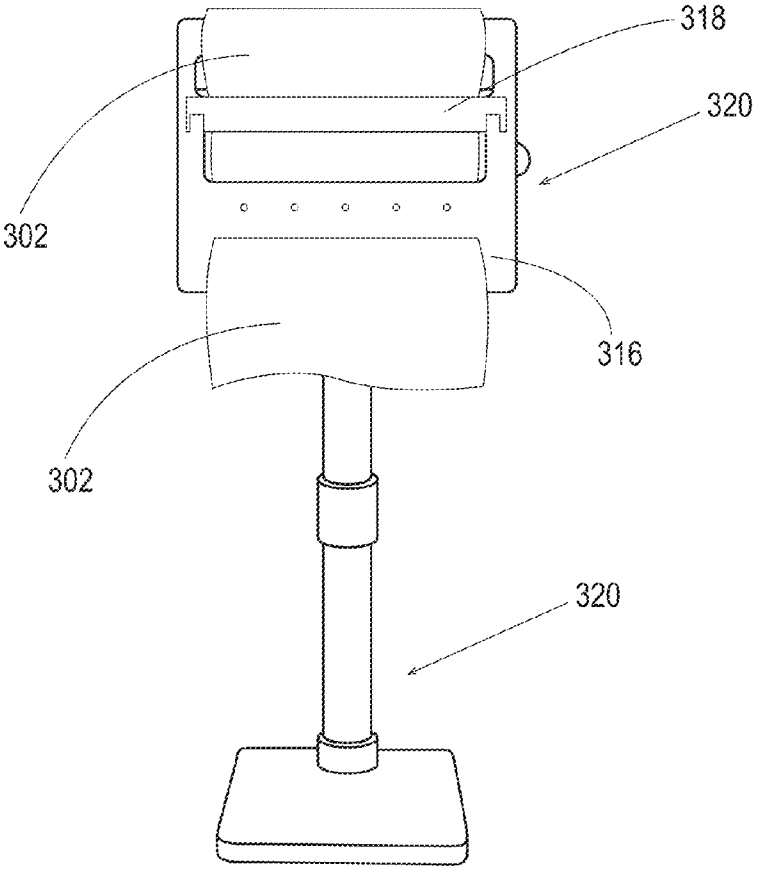
FIG. 12 is an exemplary rendering of the stand and holder of FIG. 11 having a sample contained therein in accordance with the current invention in the process of being prepared for imaging.

As shown in FIGS. 10-12, sample holder frame 312 is then desirably affixed on stand 320. In this manner, it is believed that the sample can be subjected to an applied tension in an effort to reduce the angle disposed between sample and shim 318. One of skill in the art will recognize that reducing the overall angle disposed between sample and shim 318 can practically increase the 'edge-like' qualities suitable for creating an image suitable for analysis of the sample disposed over shim 318.

In order to present a more 'edge-like' appearance of the sample for analysis by the method described herein, it may be desirable to provide a tension to the sample disposed over and about shim 318. One of skill in the art will recognize many methods to provide such tension. However, one particularly useful solution is to affix a known weight to the ends of the sample disposed over shim 318. One of skill in the art will appreciate that such a known weight is desirably affixed across the entire width of sample. For the analysis described herein, a weight of 185 g was found to provide suitable tension in a direction vertically downward (i.e., generally parallel to the Earth's gravitational field) for bath tissue and facial tissue products. Naturally, one of skill in the art can provide tension to the sample disposed upon sample holder frame 312 in any orientation—vertically downward, horizontally, or otherwise. In any regard it is desired to provide sufficient tension to the ends of the sample draped over shim 318 in the MD, CD, or combination thereof, in an effort to reduce the overall angle disposed between shim 318 and the sample draped over it. One of skill in the art will appreciate that the amount of weight affixed to the sample can be chosen based upon the known, or even presumed, physical characteristics of the sample to be analyzed. By way of non-limiting example, paper toweling may require a significant weight to be affixed in order to provide the desired edge-like appearance to the sample. Thus, some factors to consider in selecting a suitable weight to affix to the sample include, but are not limited to, sample's basis weight, density, number of plies, flexural modulus, drape, combinations thereof, and the like.

Figure 13:
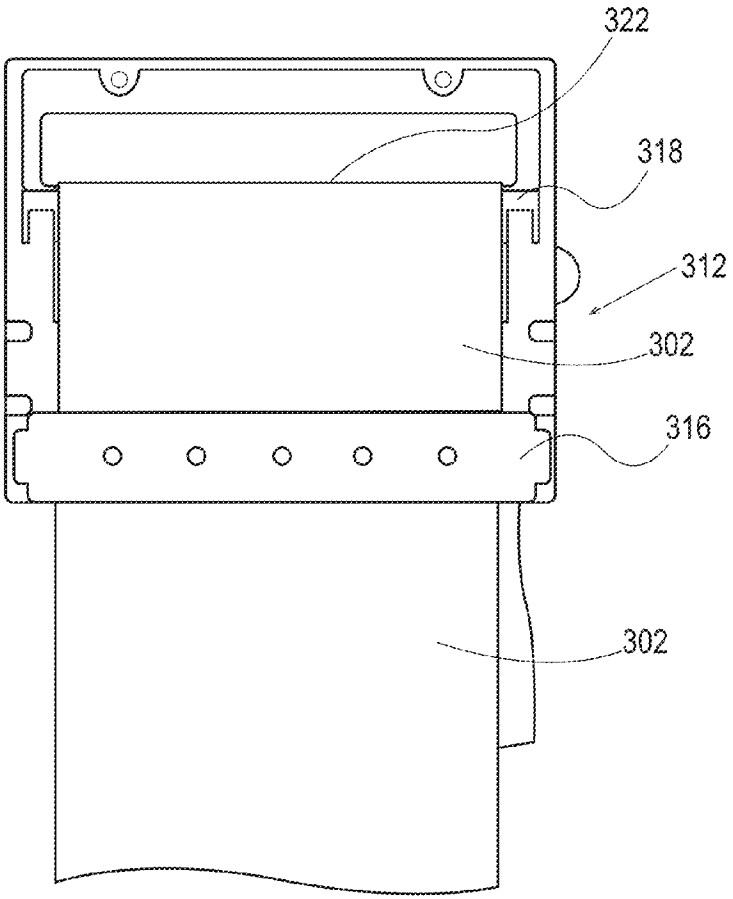
FIG. 13 is an exemplary rendering of the holder portion of FIG. 12 with the sample contained therein in accordance with the current invention.

Next the press-fit latches 316 are then pressed down to secure the tensioned sample in place. Any tensioning weight used is then removed. The resulting sample disposed within sample holder frame 312 is shown in an exemplary but non-limiting manner in FIG. 13. The combined sample holder frame 312 with sample is then placed into the sample holder 306 disposed upon the image scanner bed 308, and the image scanner 304 top is closed for imaging and generation of the image file. An exemplary but non-limiting image scanner 304 set-up is provided infra. In a desirable embodiment, a calibration image corresponding to the same region of interest is recorded (a calibration scale can be provided with graduated markings of 0.1 mm resolution) for each sample to be analyzed.

It is desirable that prior to the generation of each image file, that appropriate care is taken to clean the glass surface of the image scanner 304 and all parts cooperatively associated thereto. Additionally, one of skill in the art will appreciate that appropriate care be taken to refrain from impacting the sample in order to provide the best image possible of the sample.

Alternatively, the sample can be prepared for analysis in a manner consistent with the present disclosure by the use of microtoming. In this alternative exemplary but non-limiting embodiment, one face of a user unit of the sample can be embedded into an epoxy resin or wax block or cryogenically frozen. A sectioning instrument can then cut thin slices of the sample in the MD, CD, or any combination thereof, into sections. One of skill in the art will easily recognize that microtomy can be used to provide microtome sections having thicknesses ranging between 0.05 and 100 μm. Exemplary microtomes suitable for use in providing samples suitable for use with the present method can include sledge microtomes, rotary microtomes, cryomicrotomes, ultramicrotomes, vibrating microtomes, saw microtomes, laser microtomes, and the like. The sample can then be directly disposed upon the image scanner bed 308 and the image scanner 304 top is closed for imaging and generation of the image file.

For the exemplary method described herein, the generated image file should contain at least a two-dimensional image of a sample where at least one dimension of the image file contains at least a component of the sample in the Z-direction. For purposes of the exemplary method described herein, the generated image file will provide an image of an edge of the sample whether the edge is produced by the apparatus discussed supra, microtoming, or by any other method known to those of skill in the art for practicing the process described herein. Additionally, for purposes of this disclosure, A. Image Analysis Program The image processing system used to analyze the image file of sample is MATLAB or an equivalent mathematics software. The bold font used below denotes standard functions available within the MATLAB software. Exemplary commented code developed for this analysis is provided in Section E infra.

Figure 14:
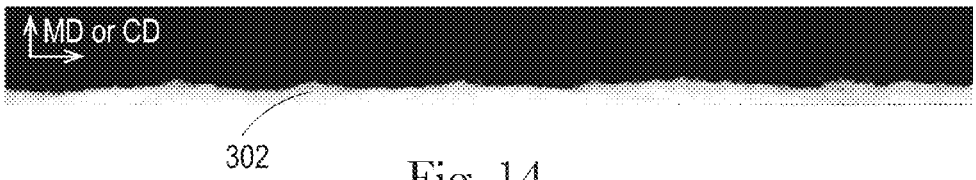
FIG. 14 is a photomicrograph of an exemplary sanitary tissue product showing free fibers emanating from a surface thereof.
Figure 15:
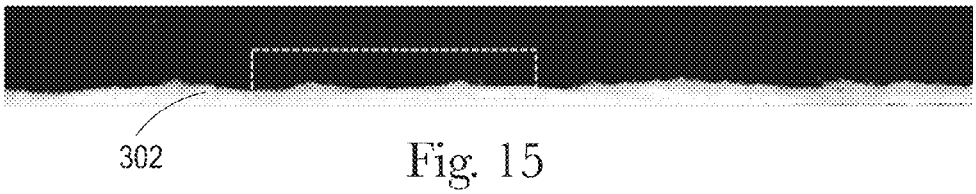
FIG. 15 is a photomicrograph of an exemplary sanitary tissue product showing free fibers emanating from a surface thereof with a region of interest (ROI) selected.
Figure 16:
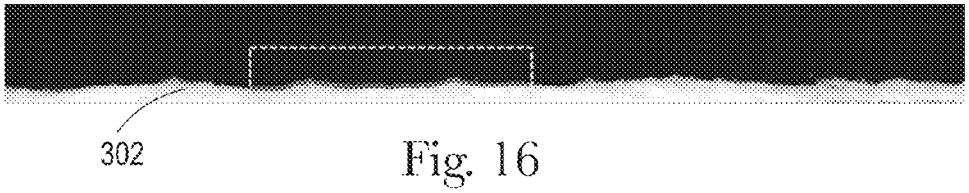
FIG. 16 is a photomicrograph of an exemplary sanitary tissue product showing free fibers emanating from a surface thereof with a region of interest (ROI) selected and a baseline filtered using an exemplary low pass butter filter, having an exemplary cut-off frequency of 30 Hz and an order of 5, determined.
Figure 17:
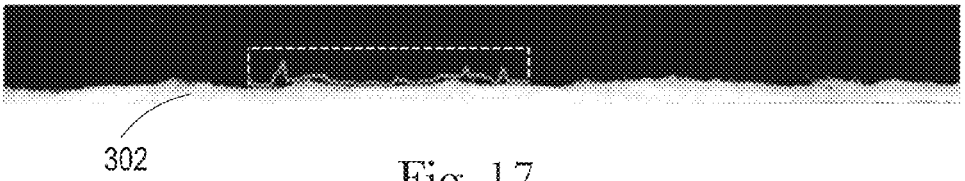
FIG. 17 is a photomicrograph of an exemplary sanitary tissue product showing free fibers emanating from a surface thereof with a region of interest (ROI) selected and an overall profile filtered using an exemplary low pass butter filter, having an exemplary cut-off frequency of 30 Hz and an order of 5, determined.
Figure 18:
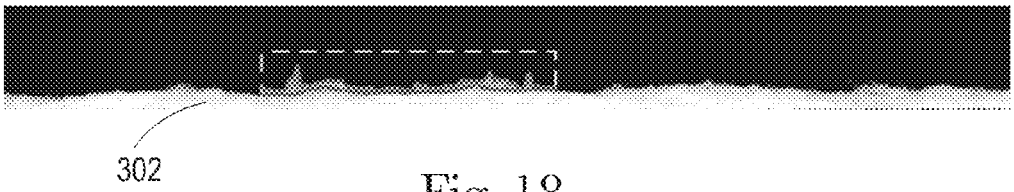
FIG. 18 is a photomicrograph of an exemplary sanitary tissue product showing free fibers emanating from a surface thereof with a region of interest (ROI) selected suitable for determining the area enclosed between the desired line profiles filtered using an exemplary low pass butter filter having an exemplary cut-off frequency of 30 Hz and an order of 5.
Figure 19:
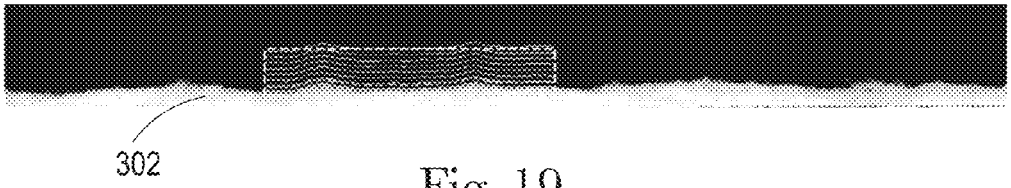
FIG. 19 is a photomicrograph of an exemplary sanitary tissue product showing free fibers emanating from a surface thereof with a region of interest (ROI) selected suitable for determining the number of free fibers counted at successive line profiles with a fixed inter-layer distance (ILD) between them; and, FIG. 20 is a graphical representation of the number of free fibers determined at successive line profiles with a fixed inter-layer distance (ILD) between them.

Referring to FIGS. 14-19, an exemplary, but non-limiting image analysis program/code is described by the following steps:

1. Referring to FIG. 14, the image file is loaded into MATLAB and contrast is corrected using the standard imadjust.m function. The width and height of the image is denoted by a component of the MD or CD directions, and Z-direction, respectively.
2. Referring to FIG. 15, the graphic interface allows the user to select a rectangular region of interest (ROI) having a width of length, L, orthogonal to the Z-direction of the sample shown in the image by clicking and dragging the mouse.
3. Referring to FIG. 16, the program desirably uses the standard im2bw.m and edge.m function to convert the image in Step 1 of this Section to a binary format and reduce the resultant to an image with only an edge profile that represents where the pixel intensity transitions from white to black. Exemplary, but non-limiting specifications of the edge.m function are: edge finding method='Canny'.
4. The position coordinates (x (width: a position along L), Z (height)) of each pixel of the edge profile is identified by measuring pixel intensity along Z (height of the image) for a single line of pixels measured using the improfile.m function. For a given x position, the coordinates of the last pixel along Z with intensity greater than zero is recorded. By convention and for non-limiting purposes, the top left corner of the image represents the origin (0, 0).

5. The analysis in Step 4 of this Section is repeated across the length, L, of the image selected in Step 3 of this Section to create a matrix of pixel positions.
6. The edge profile is obtained from the matrix of pixel positions created in Step 5 of this Section after interpolating within the matrix using the interpl.m function to ensure that every x position has an associated pixel across the width of the image selected in Step 3 of this Section. For non-limiting purposes, specifications of the interpl.m function are: method='spline' used in extrapolation for elements outside the specified interval.
7. As shown in FIG. 16, the edge profile from Step 6 of this Section is then filtered using a low pass butter filter with the exemplary specifications of a cut-off frequency=100Hz and order=5 to create a Z-direction baseline.

Calibration

Length calibration can be accomplished by determining the pixel to centimeter conversion factor. One of skill in the art will appreciate that this process involves determining the number of pixels that make up the actual physical distance between two points using the getline.m function. Generally, one of skill in the art can use a scale with graduated markings 0.01 cm apart. For non-limiting purposes, the size of the calibration image must be the same as that of the sample image analyzed.

B. Estimating the Average Effective Height of the Free Fibers

The program uses standard imfilter.m and edge.m functions to convert the image file to an image with a single line of pixels with intensity equal to one (white).

1. Specification of the imfilter.m function can be provided as a two dimensional filter (fspecial.m)='unsharp'. Specifications of the edge.m function can be: edge finding method='Canny'.
2. The function improfile.m is used to determine from the image generated above the position coordinates of the first pixel along Z (height of the image), the location of a pixel with intensity equal to one.
3. The analysis performed in Step 2 in this Section is repeated across the width of the ROI (length, L) identified in Step 2 from Section A above.
4. The edge profile obtained by creating a matrix with all the pixel positions identified in Step 3 in this Section is interpolated using the interpl.m function to ensure that the profile is described for every x position across the width of the image selected in Step 2 from Section A above. Specifications of the interpl.m function are: method='spline' used in extrapolation for elements outside the specified interval.
5. The edge profile from Step 4 in this Section is then filtered using a low pass butter filter having the exemplary specifications: Cut-off frequency=100 Hz and order=5. All Z-coordinate values along the edge profiles measured here with values greater than the corresponding Z-direction baseline estimated in Step 7 of Section A above are made equal to it.
6. The function trapz.m numerically integrates the area under the edge profile identified in Step 5 in this Section.
7. The function trapz.m numerically integrates the area under the Z-direction baseline identified in Step 7 in Section A above.
8. The net area or area enclosed between the two profiles is given by the magnitude of the difference in the absolute values of the areas estimated in Steps 6 and 7 in this Section.
9. The net area from Step 8 in this Section divided by the width of the ROI (length, L,) gives the average effective height of the free fibers in pixels.
10. Using the calibration constant estimated in the Calibration Section above the average effective height of the free fibers can be converted to centimeters.

C. Estimating the Number of Free Fibers

Figure 20:
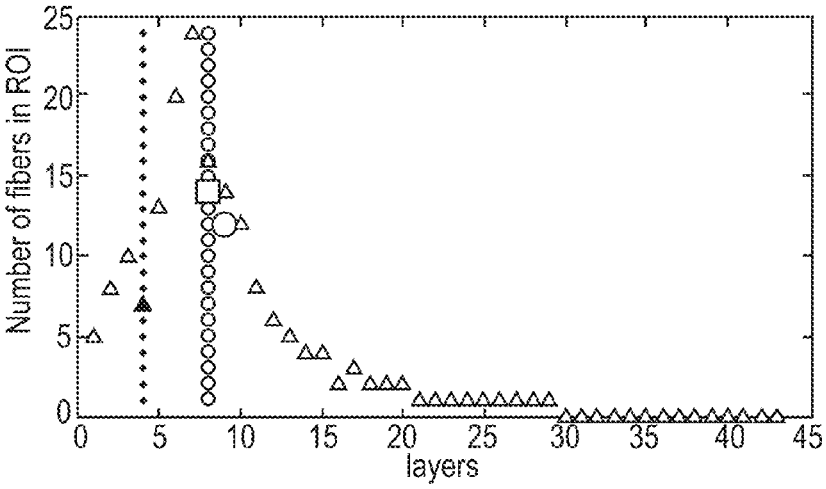

1. Pixel intensities along an edge profile across the width of the selected ROI in Step 3 from Section A above is recorded using the improfile.m function. The Z-direction baseline obtained in Step 7 from Section A above with the Z position of each pixel offset by a fixed factor can be considered a line profile.
2. The threshold intensity values for the web substrate image are obtained by processing the intensity of pixels that exist within the bounds described by the maximum Z coordinate of the image and the maximum Z-coordinate of the ROI. A suitable threshold may be developed by averaging the maximum in the derivative of the intensity (after it has been filtered using a low pass butter filter with the exemplary specifications of a cut-off frequency=30 Hz and order=1) along each line of pixels orthogonal to the Z-direction (downwards) within the section of the ROI described above.
3. The pixel intensities of the line profile is recorded as in Step 1 in this Section between the following Z coordinate limits:
   a. START: Offset a fixed distance in the Z-direction below the Z-direction baseline identified in Step 7 in Section A above. The fixed distance is two-thirds the distance between the minimum Z values of the Z-direction baseline and ROI.
   b. STOP: at a height in the image in where the mean height of pixels in the line profile is greater than the height of the ROI.
4. One of skill in the art can choose an ILD (inter-layer distance) of 1 pixel, but in the interest of computational time it may be preferred to use an ILD value that is a function of the Z-variation in the Z-direction baseline measured in Step 7 of Section A above.
5. The intensities recorded for each line profile in Step 3 in this Section can be smoothed using a moving average method.
6. For each line of pixel intensities processed in Step 5 in this Section the first derivative of intensity is computed. Peaks in the intensity derivative represent the transitions from black to white or vice versa.
7. The intensity derivative calculated in Step 6 in this Section is filtered using a low pass butter filter (exemplary and non-limiting cut off frequency=100 Hz and order=5).
8. The extrema.m function is used to identify the peaks in each profile conditioned in Step 7 in this Section. Exemplary, but non-limiting peak identification function used like extrema.m can be obtained at: http://www.mathworks.com/matlabcentral/fileexchange/12275
9. The numbers of peaks identified in Step 8 in this Section with intensity values greater than the threshold value (from Step 2 in this Section) are counted.
10. Referring to FIG. 20, the number of free fibers can be graphically presented. The number of free fibers can then be approximated as a percentage of the maximum number of free fiber in a layer that occurred above a fixed distance from the base profile. It was surprisingly found that 90% and 0.1mm distance are values that provide consistent results however, it should be understood that any percentage and distance values could be used as provided herein with success.

11. Using the calibration constant from the Calibration Section above, the number of free fibers per centimeter can be estimated.

D. Exemplary MATLAB Program for Use in Estimating the Effective Height of Free Fibers and Estimating the Number of Free Fibers in a Web Substrate The following code is suitable for providing the above-described analysis and the ensuing calculation of the above-described metrics. It should be understood by one of skill in the art that the following commented code is completely exemplary and clearly non-limiting.

```
% The code below includes comments that are preceded by the '%' sign
close all;
clear all;
clear mex;
% CALIBRATING THE IMAGE
nameimg_cal='C:\DATA ANALYSIS\Curr_Bus\';
cal=input('Input the filename for calibration:','s');
filenamebase_cal=strcat(nameimg_cal,num2str(cal),'.tif');
mm_cal=imread(filenamebase_cal);
figure(88);
imshow(mm_cal);
CALIBVAL=input('Calibration length (in cm):'); % Input distance between the markers
[hx hy]=getline;
new_CAL=CALIBVAL/sqrt((hx(2,1)-hx(1,1))^2+(hy(2,1)-hy(1,1))^2); % 1pixel = new_CAL
cm
%% DETERMINING THE AVERAGE EFFECTIVE HEIGHT OF THE FREE FIBERS
%FILE SOURCE
nameimg='C:\DATA ANALYSIS\Curr_Bus\XX.tif';
rr=colormap(jet);
mm=imread(nameimg); %Read in the image file
mm_kg=imadjust((mm));
figure(612);
imshow(mm_kg) % Show the read image
%imshow(mm_kg);
title('Original image with scale bar');
uiwait(msgbox('********NOTE: Get calibration image if ROI has been
changed*******','Title','modal')); %Request for calibration to be done
%SELECTING ANALYSIS REGION
crop_lim=getrect;   %xmin ymin width height
ulim=crop_lim;
xcrop=[crop_lim(1,1) crop_lim(1,3)+crop_lim(1,1) crop_lim(1,3)+crop_lim(1,1) crop_lim(1,1)
crop_lim(1,1)];
ycrop=[crop_lim(1,2) crop_lim(1,2) crop_lim(1,2)+crop_lim(1,4) crop_lim(1,2)+crop_lim(1,4)
crop_lim(1,2)];
figure(61); hold on;
plot(xcrop,ycrop,'y--','LineWidth',2);
figure(61);
% FIBER EDGE DETECTION
h=fspecial('unsharp');
BWM=imfilter(mm_g,h);
BW1 = edge(BWM,'canny'); %EDGE PROFILE DETECTION
imshow(BW1);
BWG=im2bw(mm_g); % Z-DIRECTION BASELINE DETECTION
BW2 = edge(BWG,'canny');
figure(343)
imshow(BW2)
figure(454);
subplot(2,1,1)
imshow(BW1) %EDGE PROFILE IMAGE
subplot(2,1,2)
imshow(BW2); %BASE PROFILE IMAGE
%VARIABLES USED
tot_ggy=[ ];
tot_ggx=[ ];
over_gg=[ ];
tt=0;
over_I=[ ];
over_pos=[ ];
over_S=[ ];
over_Spos=[ ];
figure(61); imshow(mm_g); set(gcf,'color','white');
% Z-DIRECTION BASELINE AND EDGE PROFILE IDENTIFICATION
    for ii=fix(ulim(1,1)):fix((ulim(1,1)+ulim(1,3)))
        xx=[ ];
        yy=[ ];
        yy = fix(ulim(1,2)):(fix(ulim(1,2))+fix(ulim(1,4)));
        xx = ii + zeros(1,fix(ulim(1,4))+1);
        clear gg gg_x gg_y ss ss_x ss_y;
        [gg_x,gg_y,gg] = improfile(BW1,xx,yy); % EDGE PROFILE
```

-continued

```
        [ss_x,ss_y,ss] = improfile(BW2,xx,yy); % Z-DIRECTION BASELINE
                        S=find(ss > 0,1,'last'); % IDENTIFY THE LAST PIXEL WITH INTENSITY > 0
                          if ulim(1,2)<S<(ulim(1,2)+ulim(1,4))
                                over_S=[over_S S+ulim(1,2)];
                                over_Spos=[over_Spos ii];
                                hold on;
                                plot(ii,S+ulim(1,2),'co','MarkerSize',4);%Z-DIRECTION BASELINE
                          end
                          I=find(gg==1,1,'first'); % IDENTIFY THE FIRST PIXEL WITH INTENSITY = 1
                          if I==0
                                I=ulim(1,2);
                          end
                          if I>S
                                I=S;
                          end
    over_I=[over_I I+ulim(1,2)];
    over_pos=[over_pos ii];
    hold on;
    plot(ii,I+ulim(1,2),'mo','MarkerSize',4); %OVERALL PROFILE
    over_gg=[over_gg gg];
    tot_ggx=[tot_ggx gg_x];
    tot_ggy=[tot_ggy gg_y];
    hold on;
    end
  figure(63);clf; imshow(mm_g);
%FILTERING/INTERPOLATING THE IDENTIFIED Z-DIRECTION BASELINE AND
EDGE PROFILES
        over_I(1,end)= mean(over_I);
        over_S(1,end)=mean(over_S);
    gh=butterfilter(interp1(over_pos,over_I,ulim(1,1):(ulim(1,1)+ulim(1,3)),'spline','extrap'),100,5);
%interpolated intensity locations
sh=butterfilter(interp1(over_Spos,over_S,ulim(1,1):(ulim(1,1)+ulim(1,3)),'spline','extrap'),100,5);
    for bb=1:length(sh) %REMOVING ALL EDGE PROFILE ELEMENTS THAT ARE LESS
THAN THE CORRESPONDING Z-DIRECTION BASELINE VALUES
    if (gh(bb)-sh(bb)>0)
            gh(bb)=sh(bb);
    else
            gh(bb)=gh(bb);
    end
    end
    hold on;
    plot(ulim(1,1):(ulim(1,1)+ulim(1,3)),gh,'r.','MarkerSize',6)
    plot(ulim(1,1):(ulim(1,1)+ulim(1,3)),sh,'b.','MarkerSize',6)
    jbfill(ulim(1,1):(ulim(1,1)+ulim(1,3)),sh',gh','y')
%EFFECTIVE HEIGHT ESTIMATION
A1=trapz(ulim(1,1):(ulim(1,1)+ulim(1,3)),gh);
A2=trapz(ulim(1,1):(ulim(1,1)+ulim(1,3)),sh);
A=abs(A1-A2); %units are pixel^2
Atot=A*new_CAL*new_CAL; %AEA AND ROI WIDTH CONVERTED TO cm USING THE
CALIBRATION CONSTANT
strip_width=ulim(1,3)*new_CAL;
Effective_height=Atot/strip_width;
%% ESTIMATING THE NUMBER OF FREE FIBERS PER CM
figure(61);
imshow(mm_g)
hold on
plot(xcrop,ycrop,'y--','LineWidth',2);
[Cx,Cy,C] = improfile(mm_g,ulim(1,1):(ulim(1,1)+ulim(1,3)),sh);
plot(Cx,Cy,'r--','LineWidth',2);
%FIXING #LAYERS AND INTER-LAYER DISTANCE (ILD)
kk=0;
tl=1; % Inter-layer distance (ILD) set to 1
crop_mm=mm_g;
start_pt=fix(2*(max(ycrop)-mean(Cy))/3); %START POINT FOR THE ANALYSIS
% Variables
ii=0;
x1=[ ];
y1=[ ];
over_gg=[ ];
over_gg_smt=[ ];
tot_yy=[ ];
gg_smt=[ ];
ii=kk;
% THRESHOLD VALUES FOR THE FOREGROUND AND BACKGROUND
figure(64);
imshow(mm_g)
title('Getting the foreground/background threshold values');
hold on
plot(xcrop,ycrop,'y--','LineWidth',2);
```

-continued

```
plot(Cx,Cy,'r.','LineWidth',2);
lj=size(mm_g);
tot_thresh=[ ];
max_hh=[ ];
for zz=0:(ulim(1,2)+ulim(1,4)−max(Cy))
            [hh_x,hh_y,hh]                                                    =
improfile(mm_g,ulim(1,1):(ulim(1,1)+ulim(1,3)),ones(length(ulim(1,1):(ulim(1,1)+ulim(1,3))),1)
*(max(Cy)+zz));
figure(64);
hold on;
plot(hh_x,hh_y,'g.');
tot_thresh =[tot_thresh max(butterfilter(diff(hh),30,1))];
end
thresh=mean(tot_thresh);
figure(64);
if ulim(1,2)−ulim(1,4)<0
            zz_up=ulim(1,2);
else
            zz_up=ulim(1,4);
end
max_gg=[ ];
tot_gg=[ ];
for zz=0:zz_up−1
[gg_x,gg_y,gg]=
improfile(mm_g,ulim(1,1):(ulim(1,1)+ulim(1,3)),ones(length(ulim(1,1):(ulim(1,1)+ulim(1,3))),1)
*(ulim(1,2)−zz));
figure(64);
hold on;
plot(gg_x,gg_y,'c.');
  tot_gg =[tot_gg max(butterfilter(diff(gg),30,1))];
end
bkg_val=mean(tot_gg);
ds=100;
gg=[4000]; %initializing gg
%IDENTIFYING THE #LAYERS
while ((max(Cy(1:end,1)−(tl*ii)+start_pt)> min(ycrop))) % STOP COUNTING THE NUMBER
OF FREE FIBERS WHEN LINE PROFILE GOES OUT OF THE ROI
            xx=[ ];
            yy=[ ];
            %gg=[ ];
            kk=kk+1; %counts number of layers
                ii=kk;
            xx = [Cx(1:end,1)];
            yy = [Cy(1:end,1)−(tl*ii)+start_pt]; % add offset to the start point of analysis
          [gg_x,gg_y,gg] = improfile(crop_mm,xx,yy);
            x1=[x1 xx];
            y1=[y1 yy];
              tt=size(gg);
              R=rem(kk,5);
            if(R==0)
                %ii=kk;
                                figure(610);
                                %imshow(crop_mm);
                                %plot(1:tt(1,1),gg,'Color',[fix(rr(fix(ii),1)*64/ds)      fix(rr(fix(ii),2)*64/ds)
fix(rr(fix(ii),3)*64/ds)]);
                                  plot(1:tt(1,1),gg,'Color','y');
                                %plot(xx,gg,'c');
                                xlabel('x position (pix)');
                                %ylabel('pixel intensity');
            figure(61);
            %plot(gg_x,gg_y,'Color',[fix(rr(fix(ii),1)*64/ds)                          fix(rr(fix(ii),2)*64/ds)
fix(rr(fix(ii),3)*64/ds)],'LineWidth',1);
              plot(gg_x,gg_y,'Color','y','LineWidth',1);
            end
            over_gg=[over_gg gg];
            tot_yy=[tot_yy Cy(1,1)−(tl*ii)];
            hold on;
    end
figure(61); zoom off;
title(strcat('Number of layers:',num2str(kk),'   Layer thickness (pix): ',num2str(tl)));
% SMOOTHING THE INTENSITY PROFILE
  for jj=1:kk
              Sze_gg=size(over_gg(:,jj));
              %%%   jj=1;
              for ii = 3:Sze_gg(1,1)−2
                        gg_smt(ii,jj) =(over_gg(ii−2,jj)+2*over_gg(ii−1,jj)+ 3*over_gg(ii,jj)+ 2*over_gg(ii+1,jj)+
over_gg(ii+2,jj))/9;
              end
                          figure(68);clf;set(gcf,'color','white');
```

-continued

```
                    plot(over_gg(:,jj),'r','LineWidth',2);
                    hold on
                    plot(gg_smt(:,jj),'b-','LineWidth',1);
                    ylabel('Pixel intensity');
                    xlabel('x position of pixel');
                    title(strcat('Smoothing out the intensity data-layer number: ',num2str(jj)));
    end
% ESTIMATING/COUNTING INTENSITY PEAKS/FIBERS
%Variables
tot_dd=[ ];
det_gg=[ ];
tot_dd=[ ];
figure(67);
det_gg =diff(gg_smt(:,kk));
%kk=4;
for ii=1:kk
        dd=0;
        det_gg(:,ii) = diff(gg_smt(:,ii));
        figure(65);
        axis([0 5000 -2000 2000]);
        plot(det_gg(:,ii),'Color','k');
        hold on;
        set(gcf,'color','white');
        xlabel('index');
        ylabel('derivative of intensity');
        clear filt_det num_det
        num_det=find(extrema(smooth(butterfilter(det_gg(:,ii),100,1),7))>thresh); % Picking peaks
in intensity derivative
        dd=length(num_det); %we include the -1 to account for the initial pixel transition
        if dd<0 % REMOVE POSSIBILITY OF NEGATIVE NUMBER OF FIBERS
                dd=0;
        else
                dd=dd;
        end
      figure(67);
      plot(ii,dd,'.','Color','k','MarkerSize',6,'LineWidth',2,'MarkerFaceColor','g');
      hold on
      tot_dd=[tot_dd dd];
end
figure(67);
hold on; plot(ones(1,length(1:max(tot_dd))).* fix(start_pt/tl),1:max(tot_dd),'k.');
set(gcf,'color','white');
xlabel('layers');
ylabel('Number of fibers in ROI');
%IDENTIFYING THE LAYER CORRESPONDING TO THE 0.01cm CONDITION
count_layer = fix(0.01/(new_CAL*tl));figure(67); hold on;
plot(ones(1,length(1:max(tot_dd))).* fix(start_pt/tl+count_layer),1:max(tot_dd),'ro');
plot(fix(start_pt/tl+count_layer),fix(max(tot_dd(fix(start_pt/tl+count_layer):end))*0.9),'ys','Mark
erSize',12,'MarkerFaceColor','r');
plot(fix(start_pt/tl+count_layer)+1,fix(max(tot_dd(fix(start_pt/tl+count_layer)+1:end))*0.9),'yo','
MarkerSize',12,'MarkerFaceColor','b');
figure(61);
plot(Cx,Cy-(count_layer*tl),'c--','LineWidth',1);
% ESTIMATING THE NUMBER OF FREE FIBERS
Number_of_free_fibers_per_unit_length=
fix((max(tot_dd(fix(start_pt/tl+count_layer)+1:end))/strip_width)*0.9); %90% the maximum is
taken as peak number of fibers
BEFNumber_of_free_fibers_per_unit_length=
fix((max(tot_dd(fix(start_pt/tl+count_layer):end))/strip_width)*0.9); %90% the maximum is
taken as peak number of fibers
```

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sanitary tissue product comprising a 3D patterned fibrous structure ply comprising a plurality of pulp fibers, wherein the sanitary tissue product exhibits a Free Fiber number of greater than 26 as measured according to the Free Fiber Test Method.

2. The sanitary tissue product according to claim 1 wherein the sanitary tissue product exhibits a lint of less than 15 as measured according to the Lint Test Method.

3. The sanitary tissue product according to claim 1 wherein the pulp fibers comprise wood pulp fibers.

4. The sanitary tissue product according to claim 1 wherein the pulp fibers comprise non-wood pulp fibers.

5. The sanitary tissue product according to claim 1 wherein the 3D patterned fibrous structure ply comprises an embossed 3D patterned fibrous structure ply.

6. The sanitary tissue product according to claim 1 wherein the 3D patterned fibrous structure ply comprises a through-air-dried fibrous structure ply.

7. The sanitary tissue product according to claim 1 wherein the 3D patterned fibrous structure ply is a creped through-air-dried fibrous structure ply.

8. The sanitary tissue product according to claim 1 wherein the 3D patterned fibrous structure ply is an uncreped through-air-dried fibrous structure ply.

9. The sanitary tissue product according to claim 1 wherein the 3D patterned fibrous structure ply is a fabric creped fibrous structure ply.

10. The sanitary tissue product according to claim 1 wherein the 3D patterned fibrous structure ply is a belt creped fibrous structure ply.

11. The sanitary tissue product according to claim 1 wherein the sanitary tissue product comprises a conventional wet-pressed fibrous structure ply.

12. The sanitary tissue product according to claim 1 wherein the sanitary tissue product comprises a consumer user side that exhibits the Free Fiber number.

13. The sanitary tissue product according to claim 1 wherein the sanitary tissue product exhibits a Free Fiber number of 27 or greater as measured according to the Free Fiber Test Method.

14. The sanitary tissue product according to claim 1 wherein the sanitary tissue product exhibits a Free Fiber number of 29 or greater as measured according to the Free Fiber Test Method.

15. The sanitary tissue product according to claim 1 wherein the sanitary tissue product exhibits a Free Fiber number of 30 or greater as measured according to the Free Fiber Test Method.

16. The sanitary tissue product according to claim 1 wherein the sanitary tissue product exhibits a Free Fiber number of 35 or greater as measured according to the Free Fiber Test Method.

17. The sanitary tissue product according to claim 1 wherein the sanitary tissue product exhibits a lint of less than 10 as measured according to the Lint Test Method.

18. The sanitary tissue product according to claim 1 wherein the sanitary tissue product exhibits a lint of less than 9 as measured according to the Lint Test Method.

19. A method for making a single- or multi-ply sanitary tissue product, the method comprising the steps of:

a. contacting a patterned molding member with a fibrous structure comprising a plurality of pulp fibers such that a 3D patterned fibrous structure ply that exhibits a Free Fiber number of greater than 26 as measured according to the Free Fiber Test Method is formed; and b. making a single- or multi-ply sanitary tissue product according to the present invention comprising the 3D patterned fibrous structure ply.

* * * * *